US009103210B2

(12) United States Patent
O'Connor

(10) Patent No.: US 9,103,210 B2
(45) Date of Patent: Aug. 11, 2015

(54) ROTARY DEVICE

(75) Inventor: Patrick O'Connor, Beaumaris (AU)

(73) Assignee: Lumberjack Pty. Ltd., Beaumaris (AU)

( * ) Notice: Subject to any disclaimer, the term of this patent is extended or adjusted under 35 U.S.C. 154(b) by 636 days.

(21) Appl. No.: 13/379,526

(22) PCT Filed: Jul. 1, 2010

(86) PCT No.: PCT/AU2010/000840

§ 371 (c)(1),
(2), (4) Date: Feb. 29, 2012

(87) PCT Pub. No.: WO2011/000050

PCT Pub. Date: Jan. 6, 2011

(65) Prior Publication Data

US 2012/0145119 A1 Jun. 14, 2012

(30) Foreign Application Priority Data

Jul. 1, 2009 (AU) ..... 2009903080

(51) Int. Cl.
*F02B 53/00* (2006.01)
*F01C 1/18* (2006.01)
(Continued)

(52) U.S. Cl.
CPC ..... *F01C 1/18* (2013.01); *F01B 13/067* (2013.01); *F01C 1/084* (2013.01)

(58) Field of Classification Search
CPC ..... F01C 1/18; F01C 1/084; F01C 13/067
USPC ..... 123/246, 249, 242, 200; 418/190, 196, 418/201.3, 206.2, 206.5, 206.6
See application file for complete search history.

(56) References Cited

U.S. PATENT DOCUMENTS 65,992 A * 6/1867 Bazin ..... 418/206.6
572,946 A * 12/1896 Backstrom ..... 418/202
(Continued)

FOREIGN PATENT DOCUMENTS

DE 945797 C * 7/1956 ..... F01C 1/18
DE 1061566 B * 7/1959 ..... F01C 1/18
(Continued)

OTHER PUBLICATIONS

Office Action issued in corresponding Japanese Patent Appln. No. 2012-516440 dated May 22, 2014.

*Primary Examiner* — Thai Ba Trieu
(74) *Attorney, Agent, or Firm* — Mendelsohn, Drucker & Dunleavy, P.C.

(57) ABSTRACT

A rotary device is described for use in a rotary engine, or a compressor, or turbine, the rotary device comprising two rotors disposed adjacent each other and rotatable about substantially parallel axes of rotation. Each of the rotors has protrusions extending therefrom at regular intervals about the circumference of each to define an open portion of a sealable compression chamber between adjacent protrusions. Each protrusion has two side surfaces and a projecting end surface, wherein the meeting point between each side surface and the projecting end surface defines a tip. The two rotors are arranged such that upon contra rotation of the rotors, a protrusion of one of the rotors engages between a pair of protrusions on the other rotor, and the tips of the engaging rotor are in constant sealing contact with the opposing side surfaces of the pair of protrusions for a predetermined period of time. During the predetermined period of time, a sealed chamber is formed and the volume of the chamber is reduced to a predetermined level by the contra rotation.

33 Claims, 25 Drawing Sheets

(51) Int. Cl.

| | |
|---|---|
| ***F01C 1/24*** | (2006.01) |
| ***F04C 18/00*** | (2006.01) |
| ***F01B 13/06*** | (2006.01) |
| ***F01C 1/08*** | (2006.01) |

(56) References Cited

U.S. PATENT DOCUMENTS

| | | | | | |
|---|---|---|---|---|---|
| 660,799 | A | * | 10/1900 | Morell | 418/206.6 |
| 713,443 | A | | 11/1902 | Jewell | |
| 1,207,306 | A | * | 12/1916 | Lestak | 418/9 |
| 2,504,230 | A | * | 4/1950 | Smith | 418/99 |
| 2,988,065 | A | * | 6/1961 | Wankel et al. | 123/242 |
| 3,001,481 | A | * | 9/1961 | Thompson | 418/194 |
| 3,255,737 | A | | 6/1966 | Nallinger | |
| 3,467,070 | A | * | 9/1969 | Green | 123/229 |
| 3,799,713 | A | * | 3/1974 | Cloots et al. | 418/206.4 |
| 3,862,543 | A | * | 1/1975 | Spinnett | 418/196 |
| 3,990,409 | A | * | 11/1976 | Beverly | 123/246 |
| 4,003,349 | A | * | 1/1977 | v. Habsburg-Lothringen | 418/206.5 |
| 4,078,526 | A | | 3/1978 | Gail | |
| 4,095,564 | A | | 6/1978 | Hochstein | |
| 4,702,206 | A | * | 10/1987 | Harries | 123/246 |
| 4,761,125 | A | * | 8/1988 | Inagaki et al. | 418/201.3 |
| 4,813,388 | A | * | 3/1989 | Yang | 123/249 |
| 6,146,121 | A | * | 11/2000 | Fox et al. | 418/206.5 |
| 7,281,513 | B1 | * | 10/2007 | Webb | 123/200 |
| 2003/0192503 | A1 | * | 10/2003 | James | 123/249 |

FOREIGN PATENT DOCUMENTS

| | | | | | |
|---|---|---|---|---|---|
| DE | 2422587 | A1 | * | 11/1975 | F01C 1/18 |
| DE | 3417824 | A1 | * | 11/1985 | F01C 1/084 |
| DE | 3613734 | A1 | * | 10/1987 | F01C 1/18 |
| DE | 102005037729 | A1 | * | 2/2007 | F04C 18/16 |
| DE | 102007023949 | A1 | * | 11/2008 | F04C 18/12 |
| DE | 102009021954 | A1 | * | 11/2010 | F01C 1/16 |
| EP | 1925776 | A1 | * | 5/2008 | F01C 1/14 |
| FR | 1526098 | A1 | * | 5/1968 | F01C 1/18 |
| FR | 2394670 | A1 | * | 1/1979 | F01C 1/18 |
| JP | 64000383 | A | * | 1/1989 | F04C 18/18 |
| JP | 1151719 | | | 6/1989 | |
| JP | 9-256862 | A | | 9/1997 | |
| JP | 2005-315205 | A | | 11/2005 | |
| JP | 2005315205 | | | 11/2005 | |
| RU | 2197641 | | | 1/2003 | |
| WO | 0106094 | A1 | | 1/2001 | |
| WO | 2004033856 | A1 | | 4/2004 | |

* cited by examiner

SECTION A-A

SECTION A-A

ROTARY DEVICE

FIELD OF THE INVENTION

The invention relates to a rotary device. More particularly the invention relates to a rotary device for use as an internal combustion engine for use in motor vehicles, such as cars, buses, trucks, and motorcycles, aircraft including airplanes and helicopters, and water craft, compressors, or turbines.

BACKGROUND OF THE INVENTION

The design of internal combustion engines used in motor vehicles is primarily based upon the use of reciprocating pistons. The pistons are located in cylinders and move up and down in the cylinders. When the pistons are near the top of the cylinders, a small amount of fuel is injected into the top of the cylinder above the piston and is ignited by compression and/or a spark. The ignition of the fuel causes the gas above the piston to expand rapidly to assist the piston in its downward stroke. The pistons are connected to a crankshaft via a piston rod. The crankshaft rotates and provides the force to drive the engine.

It is well recognised that this type of engine is very inefficient, partly because so much of the energy generated from the ignition of the fuel is used in the reciprocating motion of the pistons. The reciprocating motion also limits the speed that the engine can achieve. For example, such an engine can generally only achieve a maximum of about 18,000 rpm. As a result of the inefficiencies of this engine, its size cannot be reduced without compromising the power of the engine.

Whilst it has been known for some time that a rotary engine would be more efficient than a normal piston engine as described above, a successful purely rotational engine has not been achieved. This is because, all prior rotary engines:

(i) still involve at least partially reciprocating movement which as described above results in inefficiency;

(ii) fail to incorporate readily sealable chambers capable of withstanding the pressures generated at working load; and/or (iii) fail to provide for compression and combustion to occur in a common zone.

SUMMARY OF THE INVENTION

According to a first aspect of the invention, a rotary device is provided comprising two rotors disposed adjacent each other and rotatable about substantially parallel axes of rotation, wherein:

(i) each of the rotors has protrusions extending therefrom at regular intervals about the circumference of each to define an open portion of a sealable compression chamber between adjacent protrusions;

(ii) each protrusion has two side surfaces and a projecting end surface, wherein the meeting point between each side surface and the projecting end surface defines a tip; and (iii) the two rotors are arranged such that upon contra rotation of the rotors, a protrusion of one of the rotors engages between a pair of protrusions on the other rotor, and the tips of the engaging rotor are in constant sealing contact with the opposing side surfaces of the pair of protrusions for a predetermined period of time;

wherein, during said predetermined period of time, a sealed chamber is formed and the volume of the chamber is reduced to a predetermined level by the contra rotation.

The rotary device is thus arranged to use substantially rotational motion to deliver a changing positive displacement. Unlike known devices, the rotary device of the invention does not rely on reciprocating motion or eccentric motion, and is readily able to deliver increased pressure ratios of around 10:1, so suitable for use in a wide range of applications, such as an internal combustion engines, high pressure compressor units, and turbines. For applications of the rotary device of the invention with compressors or turbines, it is contemplated that pressure ratios in the order of 100:1 are achievable.

It will be appreciated that each rotor tip, when considered in three dimensions, forms an apex or edge of that rotor, which is preferably forms a straight line.

According to a second aspect of the invention, a rotary engine is provided with a compression and combustion zone comprising:

(i) two rotors disposed adjacent each other and rotatable about substantially parallel axes of rotation such rotors, wherein:

(a) each of the rotors has protrusions extending therefrom at regular intervals about the circumference to each define an open portion of a sealable compression chamber between adjacent protrusions;

(b) each protrusion has two side surfaces and a projecting end surface, wherein the meeting point between each side surface and the projecting end surface defines a tip;

(c) the two rotors are arranged such that upon contra rotation of the rotors, a protrusion of one of the rotors engages between a pair of protrusions on the other rotor, and the tips of the engaging rotor are in constant sealing contact with the opposing side surfaces of the pair of protrusions for a predetermined period of time; and (ii) an injector to inject fuel into the sealable compression chamber; and (iii) an ignition device to ignite the fuel in the sealable compression chamber;

wherein, during the predetermined period of time, a sealed compression combustion chamber is formed, the volume of the sealed compression combustion chamber is reduced to a predetermined level by the contra rotation, fuel is injected in to the sealable compression combustion chamber and subsequently ignited.

Preferably, the injector is located within the sealing housing and may be of the electronic fuel injector type.

Alternatively or additionally, one or more injectors may be mounted on one or both of the rotors.

Preferably, the ignition device is located on the inside of the housing, and may be a spark plug.

Alternatively or additionally, one or more ignition devices may be mounted on one or both of the rotors.

The sealing housing may be arranged to seal substantially half of a compression chamber or open portion during compression/combustion/expansion processes.

Various embodiments of the rotary engine according to the second aspect of the present invention can provide a number of advantages over known engines. Such advantages may include increases in fuel efficiency and reductions in production costs. In some embodiments, the weight and size of such an engine could be significantly reduced. With no reciprocating masses such as pistons, connecting rods and valves found in conventional combustion engines, the engine of the invention may produce significantly less vibration and may be much smoother in operation than a typical piston engine.

In one embodiment, the rotary engine incorporates the rotary device of the first aspect of the invention. The rotary device provides for a large number of power stages per revolution to be engaged while affording a compact and simple design involving few moving parts. Embodiments of the rotary engine according to the second aspect may therefore exhibit high output torque and high power characteristics coupled with matched efficiency levels.

Embodiments of each of the first and second aspects of the invention may include one or more of the following arrangements.

In its simplest form, the basic arrangement of the rotary device comprises only two moving parts which rotate at a generally high number of revolutions per minute (RPM). Rotary engine arrangements of this configuration may therefore be used to provide increasingly smaller units but having relatively high energy output, and may therefore find favour with application to automobiles allowing vehicles weight to be reduced and fuel savings to be realised.

According to a third aspect of the invention, a rotary compressor is provided comprising:

(i) two rotors disposed adjacent each other and rotatable about substantially parallel axes of rotation such rotors, wherein:
  (a) each of the rotors has protrusions extending therefrom at regular intervals about the circumference of each to define an open portion of a sealable compression chamber between adjacent protrusions;
  (b) each protrusion has two side surfaces and a projecting end surface, wherein the meeting point between each side surface and the projecting end surface defines a tip; and
  (c) the two rotors are arranged such that upon contra rotation of the rotors, a protrusion of one of the rotors engages between a pair of protrusions on the other rotor, and the tips of the engaging rotor are in constant sealing contact with the opposing side surfaces of the pair of protrusions for a predetermined period of time;

(ii) at least one one-way valve is located adjacent where the sealable compression chamber is formed to enable gas in the sealable compression chamber to exit the chamber, wherein, during the predetermined period of time a sealed compression chamber is formed, the volume of the sealed compression chamber is reduced to a predetermined level by the contra rotation, and the gas thus compressed is allowed to exit the sealed compression chamber via the at least one one-way valve.

Embodiments of the compressor according to the third aspect of the present invention have the potential to deliver increased pressures and air flow levels, due to the unique combination of positive displacement, increased RPM and with increased pressure ratios. Normally, piston compressors have positive displacement with high pressure ratios but retain poor capacity for volume. Such arrangements have a low capacity for volume because of their limitation with RPM which largely results from vibrational stresses through the reciprocating mass arrangement. Other current compressors, such as dynamic compressors, have a high volume capacity but are very limited in their ability to provide high pressure due to not creating a positive displacement. Accordingly, embodiments of the compressor according to the present aspect of the invention may demonstrate improved characteristics of these known compressors by providing a positive displacement compression improved volume flow, high pressure ratios and capacity for higher RPM.

Further potential advantages of the compressor of this third aspect include:

- the capacity to ramp up to operating pressure significantly faster than a standard compressor;
- improved dynamic pressure build up with high CFM, thus requiring a significantly smaller storage tank than a conventional compressor;
- with no reciprocating masses the unit is more reliable and requires less maintenance, and is quieter with less vibration and lower running costs;
- the ability to adapt the technology for use in the natural gas industry for compressing gases into liquid form or pumping gases over large distances.

Preferably, the gas is collected in a collection device after it exits the at least one one-way valve. As more gas is forced into the collection device, the gas in that collection device is compressed. This compressed gas may be stored for use as required.

The sealing housing may be arranged to seal substantially half of a compression chamber or open portion during the relevant compression process.

Preferably, the at least one one-way valve is located within the housing. Alternatively or additionally, the at least one one-way valve may also be located in the rotors.

The compressor may be arranged to utilise a drive means such as an electric motor to drive the compression cycle. The drive means may be configured to be speed controlled to achieve a desired speed level (revolutions per minute).

The compressor may comprise a drive train arrangement operatively associating the rotors with one another. The connection between the drive means and the drive train may be by way of a toothed belt or gears.

According to a fourth aspect of the invention, a turbine is provided comprising:

(i) two rotors disposed adjacent each other and rotatable about substantially parallel axes of rotation, wherein:
  (a) each of the rotors has protrusions extending therefrom at regular intervals about the circumference of each to define an open portion of a sealable expandable chamber between adjacent protrusions;
  (b) each protrusion has two side surfaces and a projecting end surface, wherein the meeting point between each side surface and the projecting end surface defines a tip; and
  (c) the two rotors are arranged such that upon contra rotation of the rotors, a protrusion of one of the rotors engages between a pair of protrusions on the other rotor, and the tips of the engaging rotor are in constant sealing contact with the opposing side surfaces of the pair of protrusions for a predetermined period of time;

(ii) at least one one-way valve is located adjacent where the sealable expandable chamber is formed to enable compressed gas to enter the sealable expandable chamber, wherein, during the predetermined period of time, a sealed expansion chamber is formed, and the gas is allowed to enter the sealed expansion chamber via the at least one one-way valve so as to expand the expandable chamber for causing rotation of the rotors.

According to this aspect, the rotary turbine is arranged to convert gases under pressure into rotary motion.

Each rotor of the turbine may be arranged having respective internal valve assemblies. In one embodiment, each internal valve assembly comprises a conduit providing fluid communication between the expandable chamber and a compressed gas source.

During operation, gases from a compressed gas source enter the expandable chamber formed between the two rotors via a respective valve assembly. The entering gas expands the expandable chamber volume thereby resulting in rotation of the rotors.

In one embodiment, pressurised gas enters the expandable chamber between the rotors when the chamber is at its smallest in volume. The gas pressure forces the chamber to become larger in volume, thereby causing rotation of the rotors. As the rotation occurs, the pressure in the gas decreases as its energy is used to expand the chamber. Such a turbine can provide a direct and efficient way of converting a pressurised gas into rotational motion for the purposes of electricity generation or vehicle propulsion. In operation, the rotors rotate in substantially the opposite direction relative to the positioning of the valves and/or ports as compared to that for the compressor arrangement defined above.

The turbine may run efficiently on lower pressures thereby not requiring the higher super heated steam pressures of current power generators which require huge quantities of fuel. Such lower pressure requirements would suit electricity generation from steam production particularly in the solar thermal and geothermal sectors. It may also have an application to achieve efficiency gains in the coal fired sectors.

Preferably, in accordance with any of the aspects of the invention defined above, each of the rotors is cylindrical. Typically the respective axes of rotation of the rotors are aligned. For example, the axis may be vertically aligned or they may be aligned in another direction, according to application. It will be understood that embodiments of the rotary engine of the second aspect may be included in a larger entire engine in an air/land or water craft.

Preferably, the protrusions are formed separately of the rotors. In this arrangement the protrusions will need to be affixed by any suitable means eg. adhesive, welding, force-fitting, bolts, screws or other known fastening arrangements. In an alternative preferred form of the invention, the protrusions can be formed integrally with the rotors.

It will be appreciated that any number of protrusions per rotor can be used. The design of the protrusions can be used to, vary the shape of the chamber and therefore achieve different output characteristics. The height of the protrusions can also be changed to vary the shape of the chamber.

Typically, the projecting end surface of a protrusion is a convex curve, but may take another form, such as concave or planar, as necessary to achieve a particular chamber volume. Typically, the projecting end surfaces on a rotor is a circular arc concentric with the axis of rotation of the rotor. In this form it may be shaped not to engage the rotor surface as it moves into and out of the open portion of the chamber.

Typically, the shape of the side surfaces of each protrusion are curved concave surfaces. In this way, as one rotor rotates relative to the other, each of the tips of the projecting end surface of a protrusion on said one rotor scribes a curve which follows the concave curve of the side surface of the protrusion on said other rotor, and forms a constant point of contact between the tip and the side surface throughout the entire stroke. A concave curve profile has been found to be of suitable shape for the side surfaces. In one embodiment, an exponential concave curve is particularly adapted for each side surface.

Sealing material may be incorporated into, or applied to, each tip to assist in sealing the chamber. This enhances a dynamic apex or edge-seal to the chamber, helping seal the chamber throughout the entire stroke, so to withstand (for example) compression and combustion pressures typically formed at working load. The sealing material may be similar to those apex or edge seals widely available in the automobile industry for use in engines such as the Wankel rotary engine used in some Mazda vehicles.

Sealing fluids of selected characteristics (in particular, lubricity and viscosity) are preferably used for assisting in sealing the compression chamber and providing the required mechanical environment, in accordance with the specific application.

Preferably, the area in which the chamber is formed and is subsequently disassociated is enveloped by a sealing housing. This sealing housing abuts the rotors and the protrusions. This (if necessary, in association with the applied sealing fluid) further ensures the sealing of the chamber.

Typically, this sealing housing includes an air inlet to introduce air into the open portion of the chamber. Such air may be provided to the inlet from a compressed air source. The sealing housing may also cover the open portion of the following chamber so as to increase the volume of air to be compressed in each chamber and thereby increasing the maximum compression ratio. In one embodiment, the sealing housing is arranged to cover the open portion of the following chamber so as to double the volume of air to be compressed in each chamber and thereby double the maximum compression ratio.

The sealing housing may also include an exhaust outlet to receive the exhaust gases from the chamber after combustion has taken place.

Centrifugal compressor units may be arranged to increase the air intake into the open portion of the compression chamber. Furthermore, such centrifugal compressor units may also be arranged to increase exhaust of the air/gases from the chamber.

It will be appreciated that in this specification and claims where valves are referred to, such may comprise various arrangements involving ports in operable association with one or more closure elements, and arranged for opening and closing the or each ports. For example, a valve arrangement may be configured such that one of the rotors operates as the valve element moving so as to obscure/unobscure the respective port in turn in accordance with a desired flow of air/gas through the port during operation of the rotary device. Accordingly, reference to valves in the detailed description and the claims is intended to cover all such arrangements involving closure mechanisms configured to open and close one or more ports.

According to a fifth aspect of the present invention, the rotary compressor and turbine arrangements of the third and fourth aspects of the invention may be configured so as to be in operable association with one another for providing a renewable energy source.

In one embodiment, the rotary compressor and turbine arrangements are configured so as to be in operable association with one another for providing a storage system for a renewable energy source.

Wind turbines, solar photovoltaic generators and solar thermal generators can have their intermittent outputs stored as compressed air by way of the compressor arrangement according to the third aspect of the present invention. Stored compressed air provides a low cost energy storage facility incurring little energy loss over short or long time periods, and which can then be converted efficiently back to electricity on demand through energy transfer from the turbine of the fourth aspect of the invention.

Various valve/port arrangements and combinations may be applied to various embodiments of the above described aspects of the invention. For example, valve assemblies may be provided internal of each rotor for directing gases to or from the respective chamber(s). Alternatively, outlet ports may be provided in the sealing housing at locations adjacent the respective chamber(s) for allowing gases within the chamber(s) to enter/exhaust when required.

It will be appreciated that the aperture openings of the respective valve assemblies may be arranged so as to be variable for allowing the port timing and duration of the aperture opening can be adjusted to optimise compressor, engine or turbine efficiency.

BRIEF DESCRIPTION OF THE DRAWINGS

The rotary engine form of the invention will now be further explained and illustrated by way of example only with reference to the accompanying drawings in which:

FIGS. 6A-6D show a compression sequence of the rotary device of FIG. 1 in which the rotors rotate through 45 degrees, in which:

FIG. 6A shows the rotors at 0 degrees rotation,

FIG. 6B shows the rotors at 15 degrees rotation,

FIG. 6C shows the rotors at 30 degrees rotation, and,

FIG. 6D shows the rotors at 45 degrees rotation;

FIG. 7A and FIG. 7B show the rotor device of FIG. 1 during two stages of compression in which:

FIG. 7A shows the rotors during the first stage of compression, and

FIG. 7B shows the rotors during the second stage of compression;

DETAILED DESCRIPTION OF DRAWINGS

Figure 1:
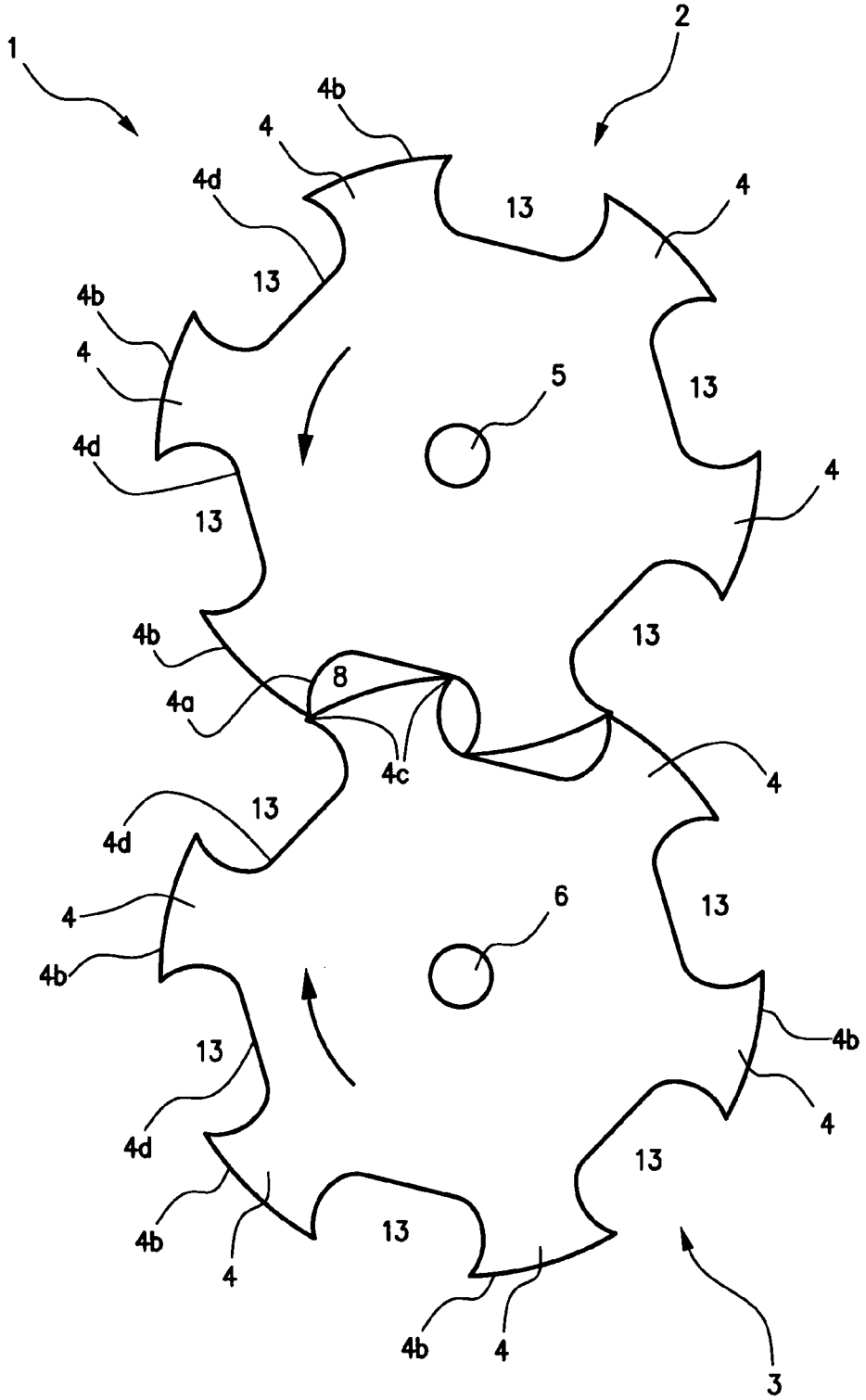
FIG. 1 is a part cross-sectional view of the rotary device showing the early stages of formation of the compression chamber, according to one form of the invention.

One embodiment of a rotary device 1 is shown in FIGS. 1 to 5. The rotary device 1 has two cylindrical rotors 2 and 3. Each of the rotors 2 and 3 has protrusions 4. The rotors 2 and 3 rotate about their respective axes 5 and 6. The axis 5 and 6 of the rotors 2 and 3 are arranged substantially parallel one another. The orientation of the axes of the rotors may be vertical, or otherwise, as required by the particular application. The top rotor 2 rotates in an anti-clockwise direction, while the lower rotor 3 rotates in a clockwise direction.

The protrusions 4 are located at regular positions around the circumference of rotors 2 and 3. Open portions 13 are formed between adjacent protrusions 4 and the circumference of each of the rotors 2,3. Each protrusion 4 has two side surfaces 4*a* and a projecting end surface 4*b*, wherein the meeting point between each side surface 4*a* and the projecting end surface 4*b* defines an apex or tip 4*c*. The two rotors 2,3 are arranged such that upon contra rotation, a protrusion 4 of one of the rotors engages between a pair of protrusions 4 on the other rotor, and the tips 4*c* of the protrusion of the engaging rotor are in constant sealing contact with the opposing side surfaces 4*a* of the pair of protrusions 4 for a predetermined period of time. Rotor faces 4*d* are defined between adjacent protrusions 4. As the rotors 2 and 3 rotate the protrusions 4 and the open portions 13 form sealed compression chambers 8. The shape and volume of the compression chambers 8 changes as the rotors 2,3 rotate.

Protrusion tips 4*c* scribe the side surfaces 4*a* so that the compression chamber 8 is formed as tip 4*c* moves along an opposing side surface 4*a*. The side surfaces 4*a* are generally curved concave in shape but may also of a concave exponential shape. A sealing material is applied to a respective side surface 4*a* to form an edge- or apex-seal between the respective tip 4*c* and an opposing side surface thereby ensuring the compression chamber 8 is able to remain sealed at compression pressures (and, in the case of the rotary engine device, combustion pressures) generated at working load. The sealing material may be similar to those apex or edge seals widely available in the automobile industry for use in engines such as the Wankel rotary engine used in some Mazda vehicles.

Sealing fluids of selected characteristics (in particular, lubricity and viscosity) are preferably used for assisting in sealing the compression chamber and providing the required mechanical environment, in accordance with the specific application. The rotary device 1 may be arranged to provide a rotary engine 1*a* as shown in FIGS. 3, 8 to 11, and 15*a* to 17. In such an arrangement, the compression chambers 8 serve to provide respective compression combustion chambers. With reference to the figures, a sealing housing 7 is arranged to enclose the area in which the compression/combustion processes take place. The sealing housing 7 abuts the rotors 2,3 and the protrusions 4 thereby sealing the compression chambers 8. This maximises the energy obtained from combustion. Accordingly, the sealing housing 7 encloses the region between the two rotors 2 and 3 and in particular the compression chambers 8 which are formed by the protrusions 4 and the open portions 13 of the rotors 2,3.

Figure 15A:
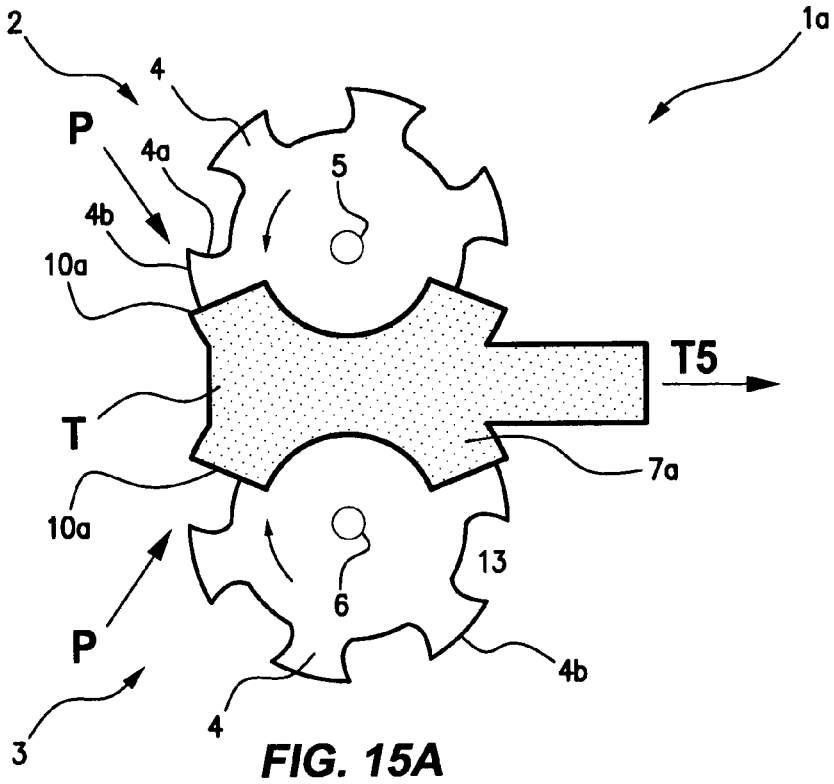
FIG. 15A is a is a cross-sectional view of the rotary engine of FIG. 8 with an alternative sealing housing.
Figure 15B:
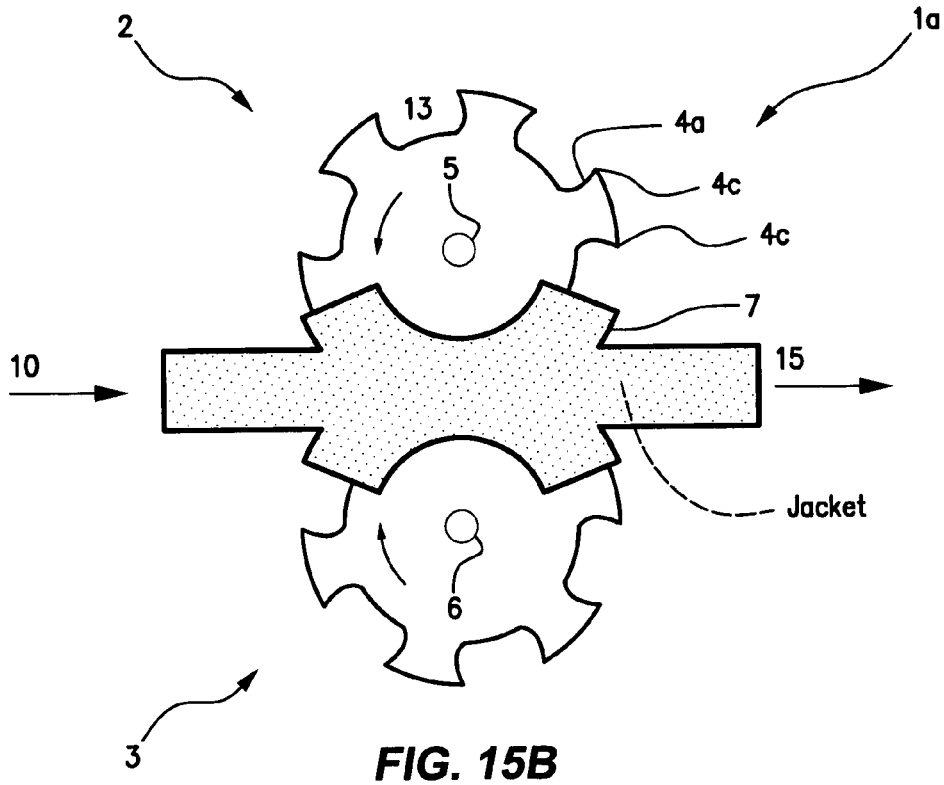
FIG. 15B is a is a cross-sectional view of the rotary device of FIG. 8 with a further alternative sealing housing.
Figure 16:
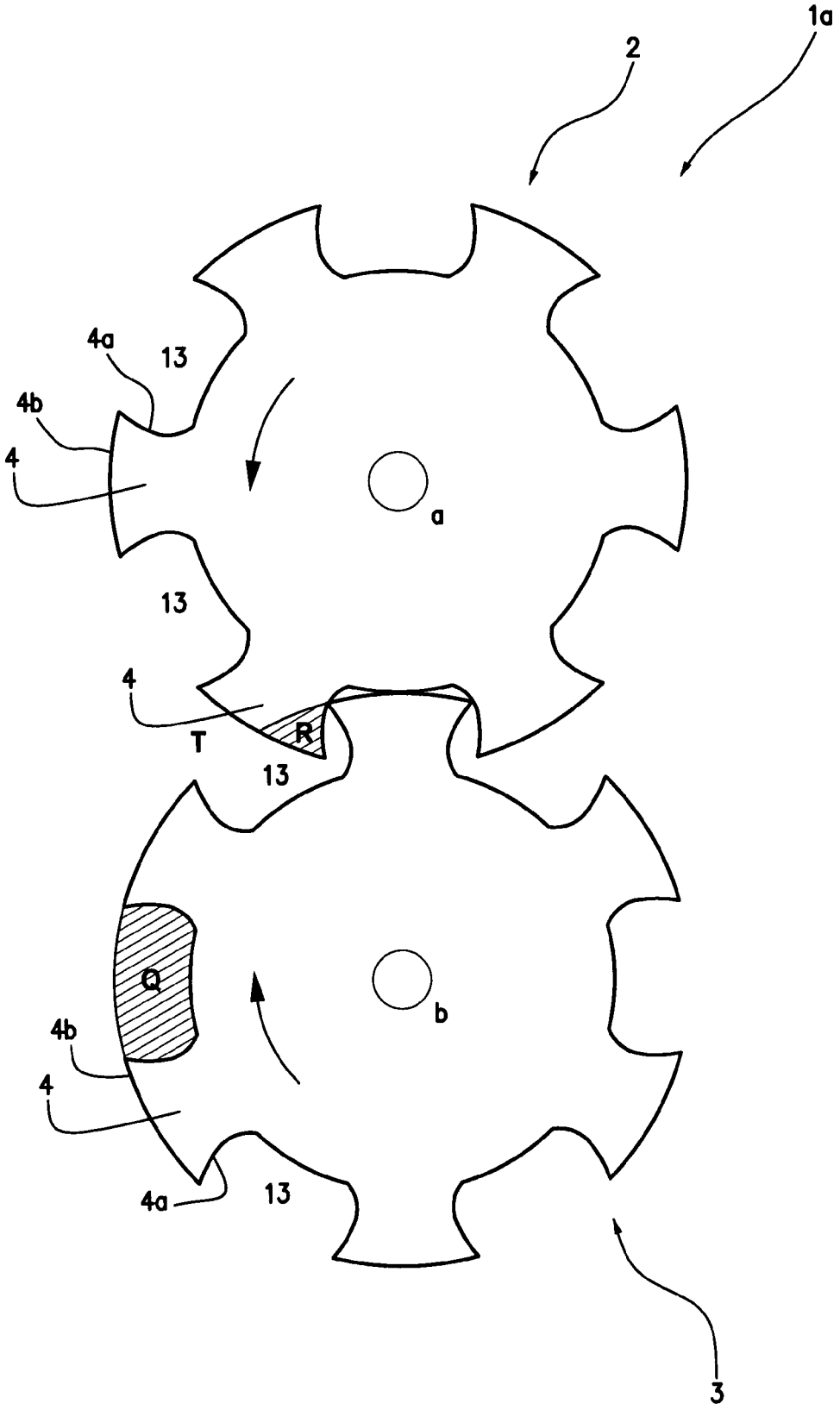
FIG. 16 is a cross-sectional view of the rotary device of FIG. 15A annotated to explain the operation of the sealing housing.
Figure 17:
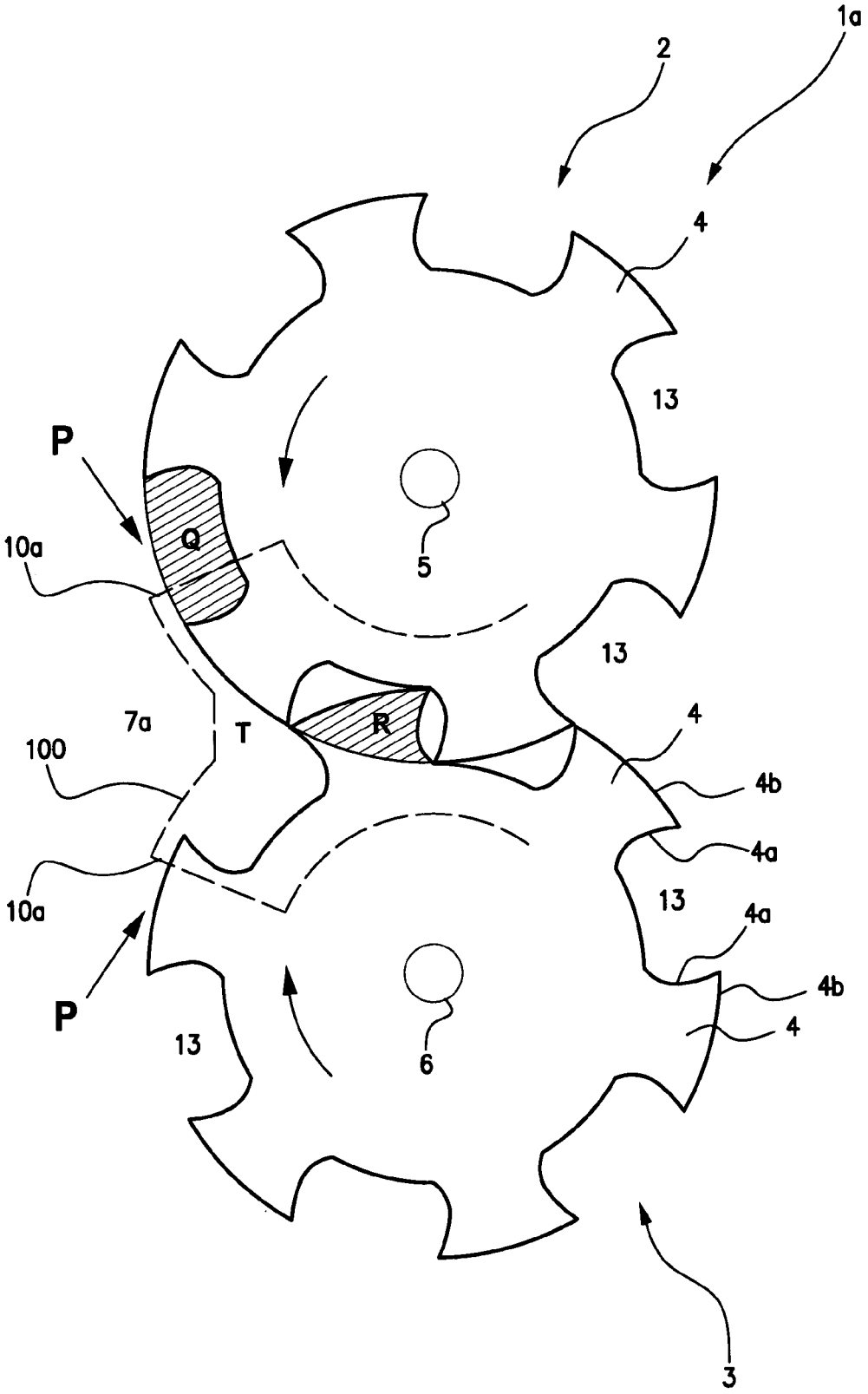
FIG. 17 is a cross-sectional view of the rotary device of FIG. 15A annotated to explain the operation of the sealing housing, with said sealing housing partially shown.
Figure 18:
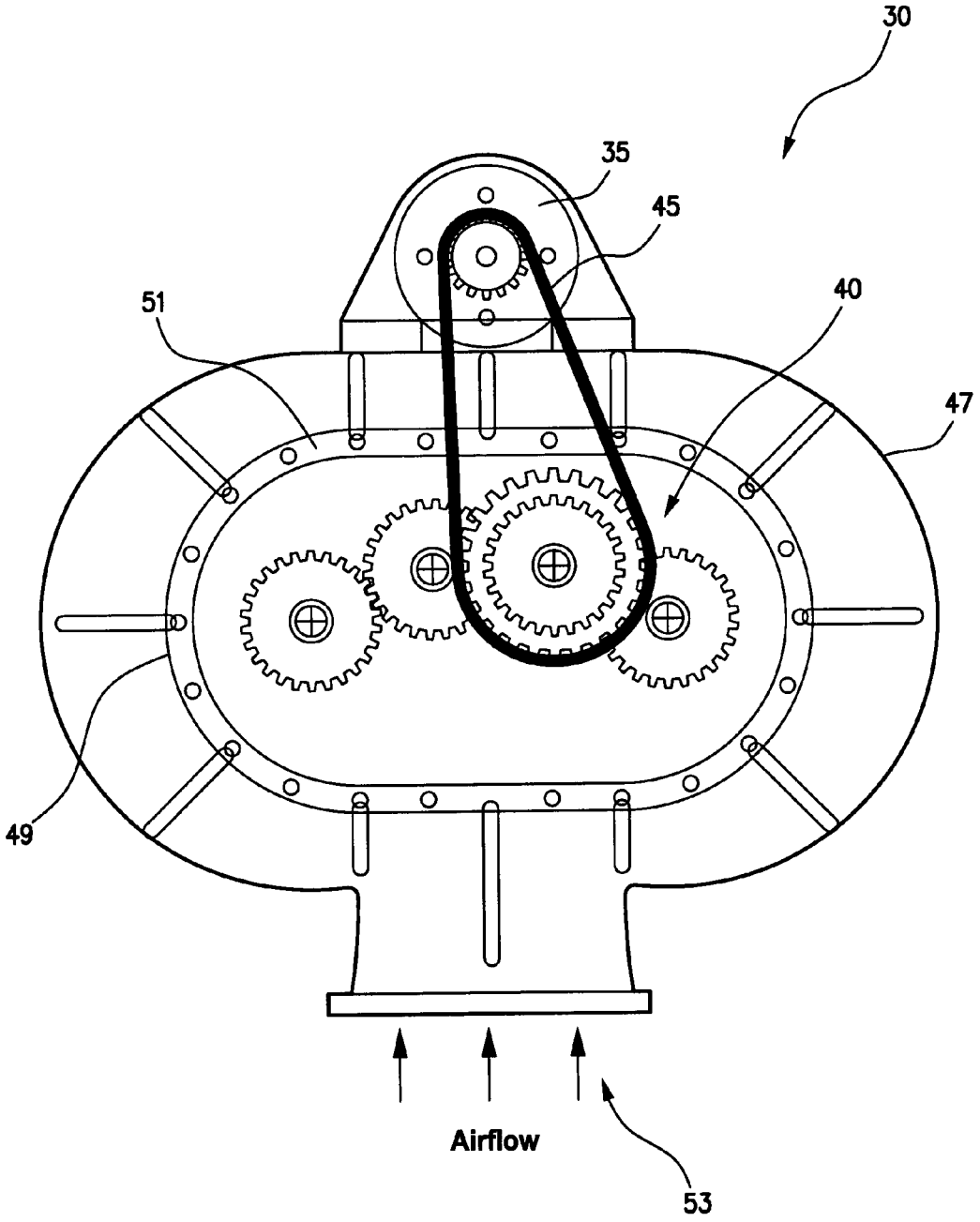
FIG. 18 shows a schematic view of the rotary device shown in FIG. 1 arranged to operate as a compressor.
Figure 19:
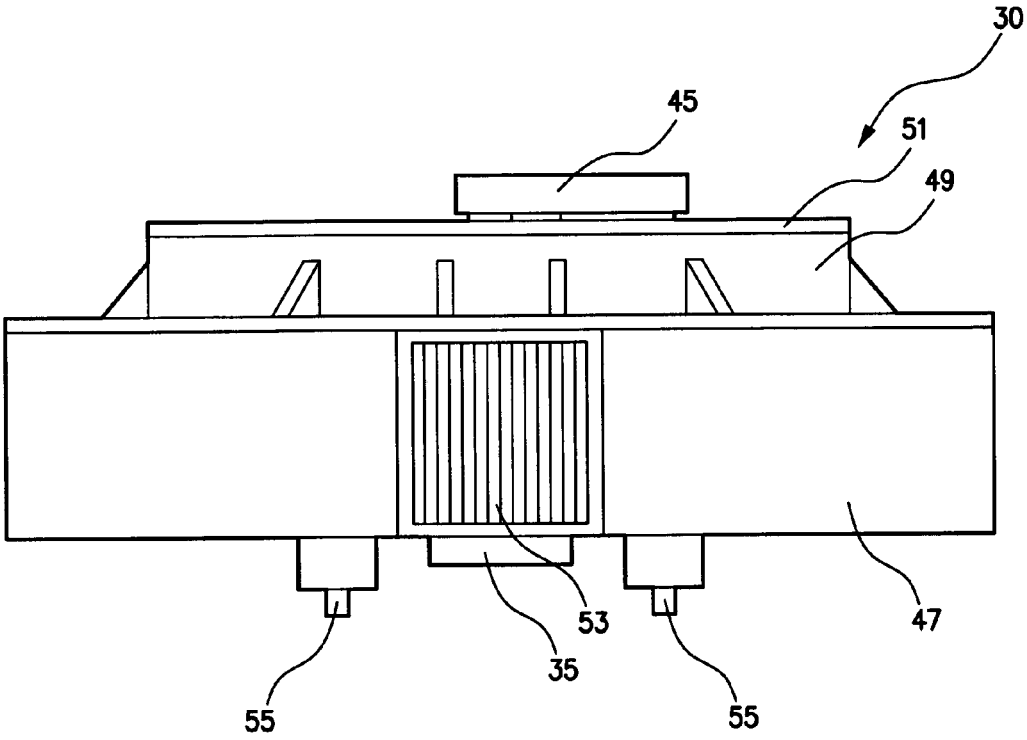
FIG. 19 shows a front view of the compressor arrangement shown in FIG. 18.
Figure 20:
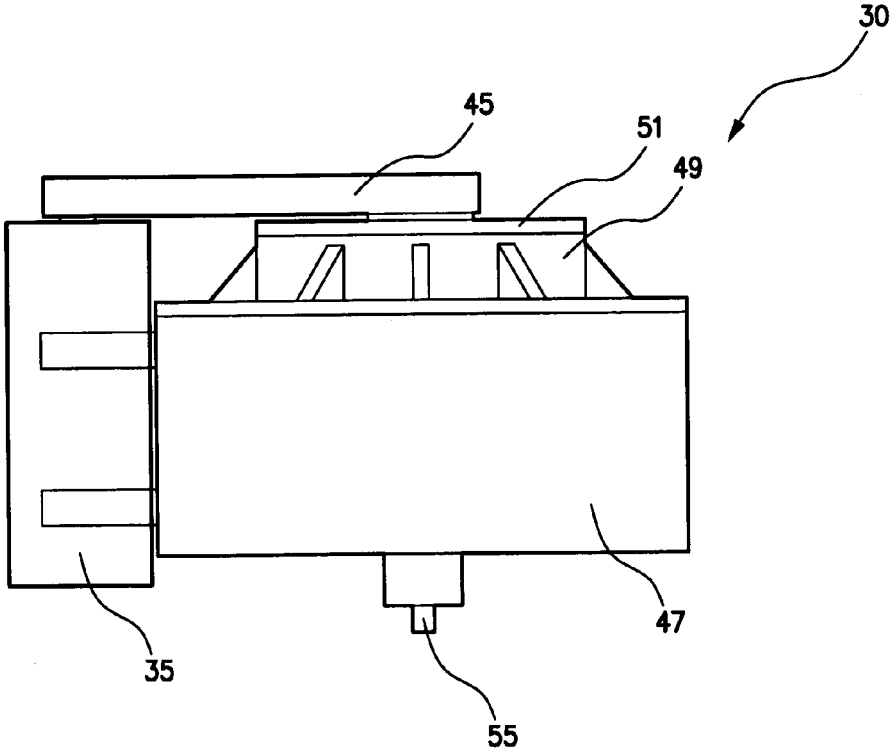
FIG. 20 shows an end view of the compressor arrangement shown in FIG. 19.

It will be understood that the sealing housing 7 could take a variety of forms. FIG. 15A shows an alternative sealing housing 7A. In FIGS. 15A to 17, air is introduced to the rotary engine 1*a* at atmospheric pressure in areas P via air flow channels 10*a*. Q shows the amount of air being introduced at each area P via air flow channels 10*a*. As each protrusion 4 begins to intrude upon an area Q (see FIG. 16) between protrusions on the other rotor 2,3, air is displaced. This displaced air is therefore forced into area T. As the amount of air displaced increases, area T becomes a preliminary compression area (refer in particular FIG. 17). The volume of air displaced (R) is equivalent to the amount of protrusion 4 of one rotor 2,3 which falls within the open portion 13 between two protrusions 4 on the other rotor 2,3. Any type of variable valve could be attached to the sealing housing 7*a* adjacent to the area T to raise or lower the compression or pressure in the area T. Raising or lowering the pressure in area T would increase or decrease, respectively, the engine speed.

Figure 2:
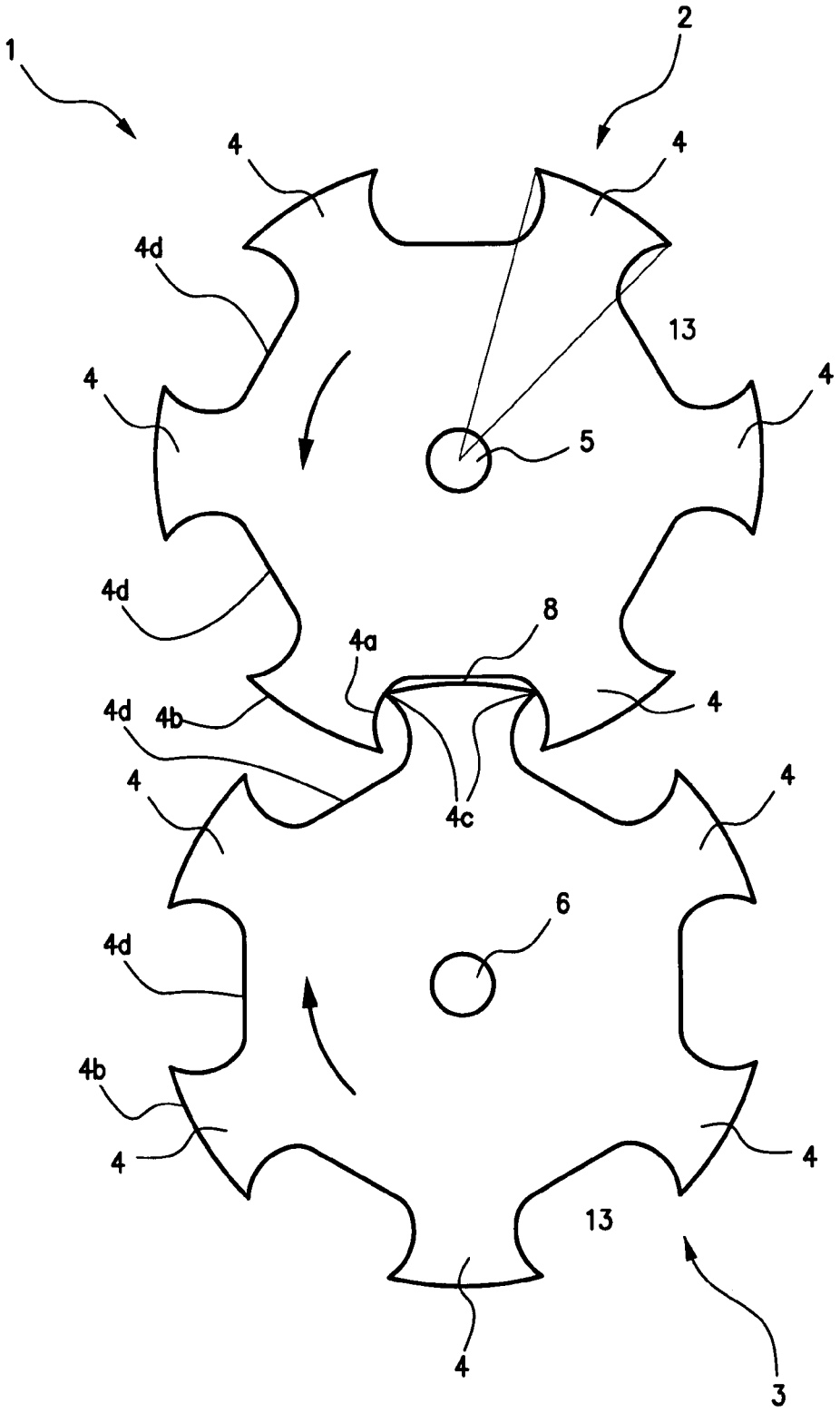
FIG. 2 is a part cross-sectional view of the rotary device of FIG. 1 at maximum compression.
Figure 3:
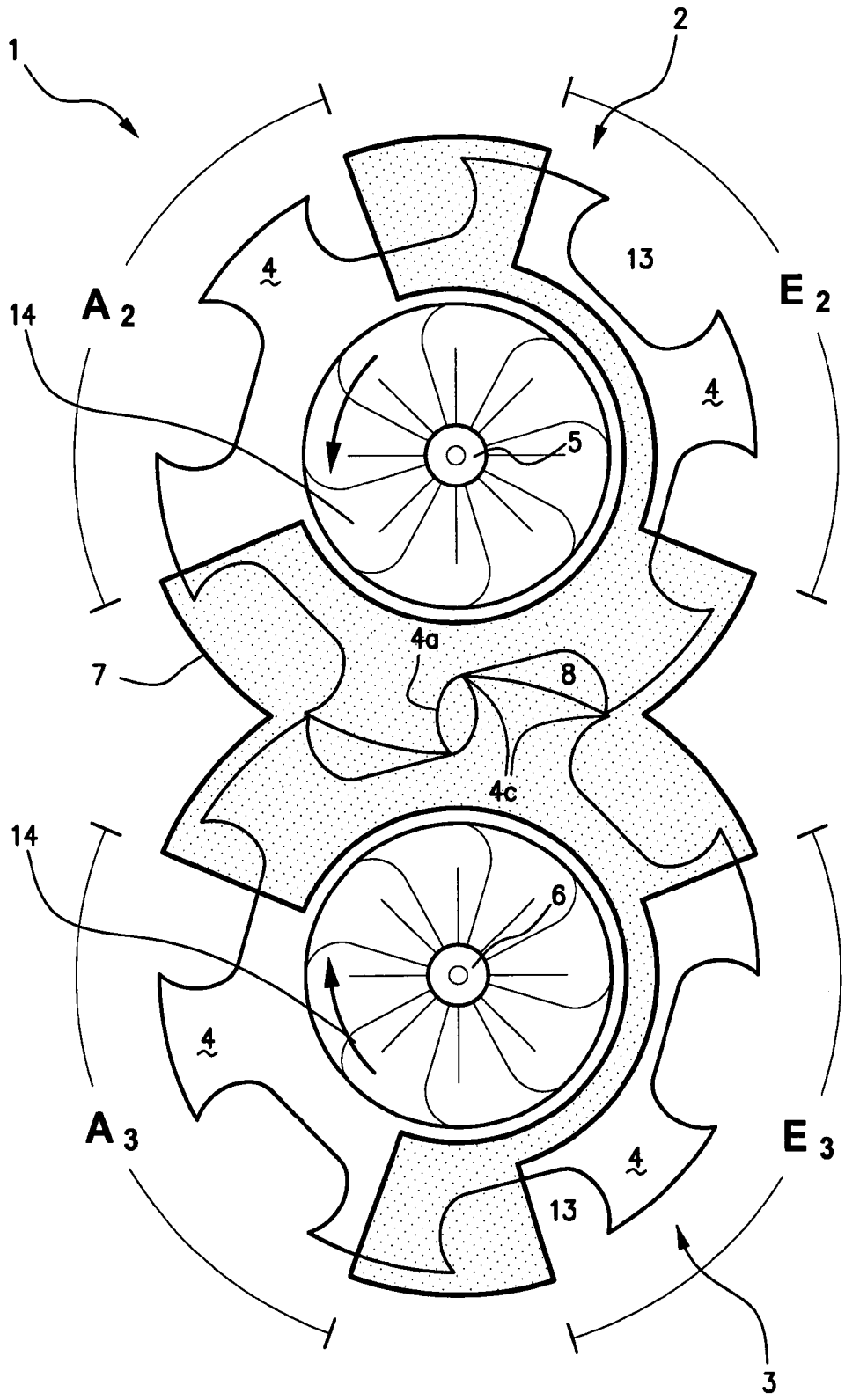
FIG. 3 is a part cross-sectional view of the rotary device of FIG. 1 with the rotors further rotated also showing one form of centrifugal compressors and a sealing housing.
Figure 4:
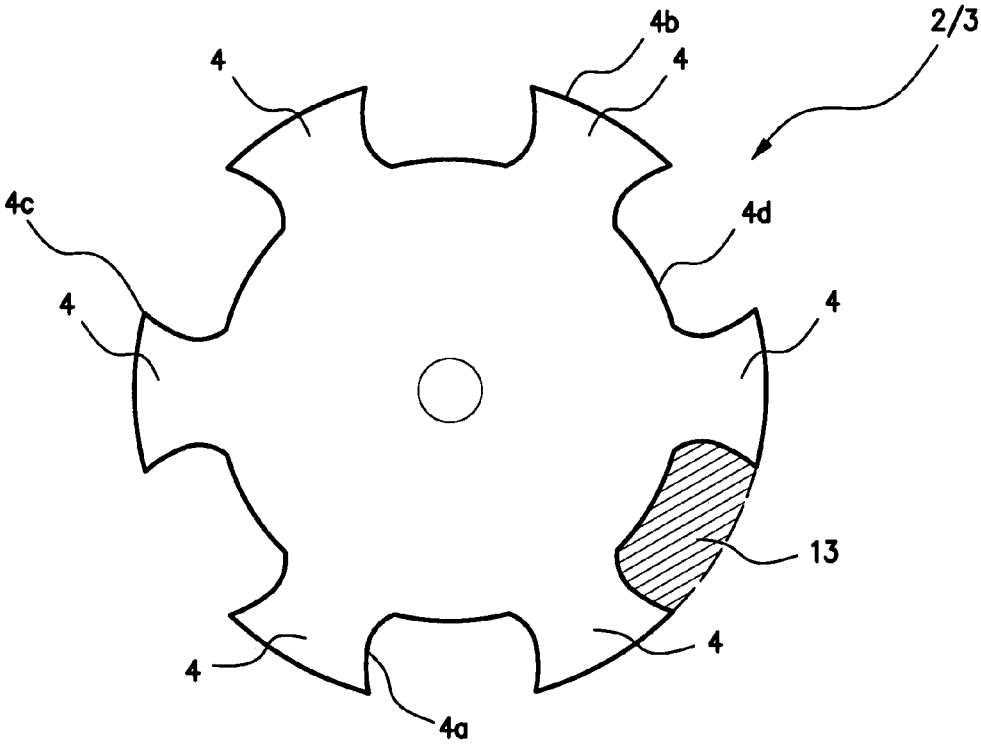
FIG. 4 is a part cross-sectional view of one rotor shown in FIG. 1.

As previously mentioned, as the rotors 2,3 rotate the protrusions 4 and the open portions 13 form compression chambers 8. The compression chamber 8, as shown in FIG. 1, is relatively initially large. As the rotors 2 and 3 rotate, the shape of the compression chamber 8 changes to a form of minimum volume as shown in FIG. 2. Compression chamber 8, as shown in FIG. 3, shows the shape of the compression chamber 8 prior to dissociation.

A sequence of the compression cycle for the rotary device/engine 1/1*a* is shown in FIGS. 6A to 6D. For the embodiment shown, rotors 2,3 each comprise six protrusions. Compression occurs between each of the rotor faces 4*d* and their opposing projecting end surfaces 4*b* of the opposing rotor providing twelve compression cycles which occur per rotor rotation. The sequence therefore illustrates one of the possible twelve compression strokes which occur within a single revolution of the rotors 2,3.

Figure 6A:
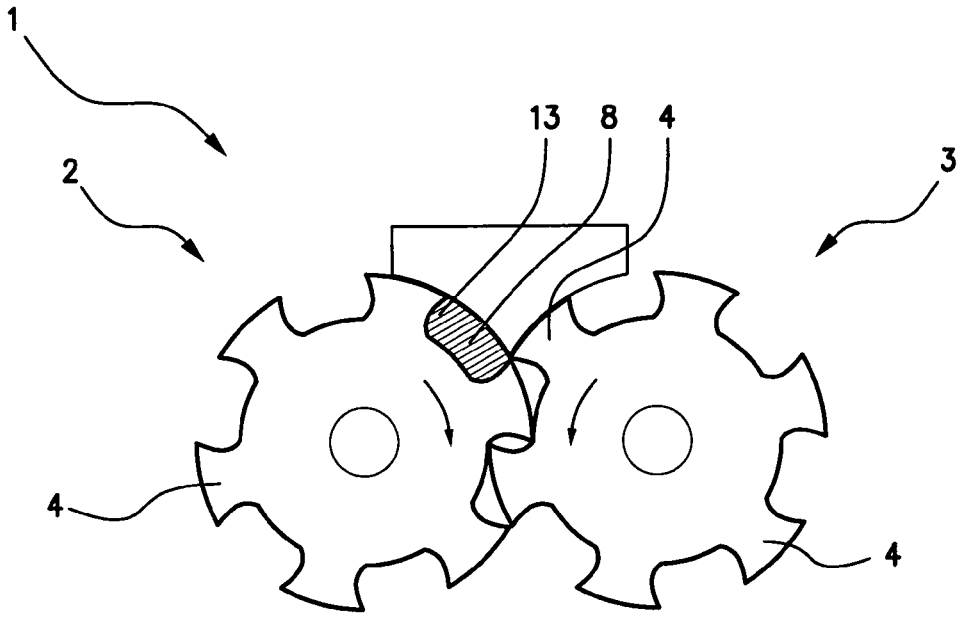
Figure 6B:
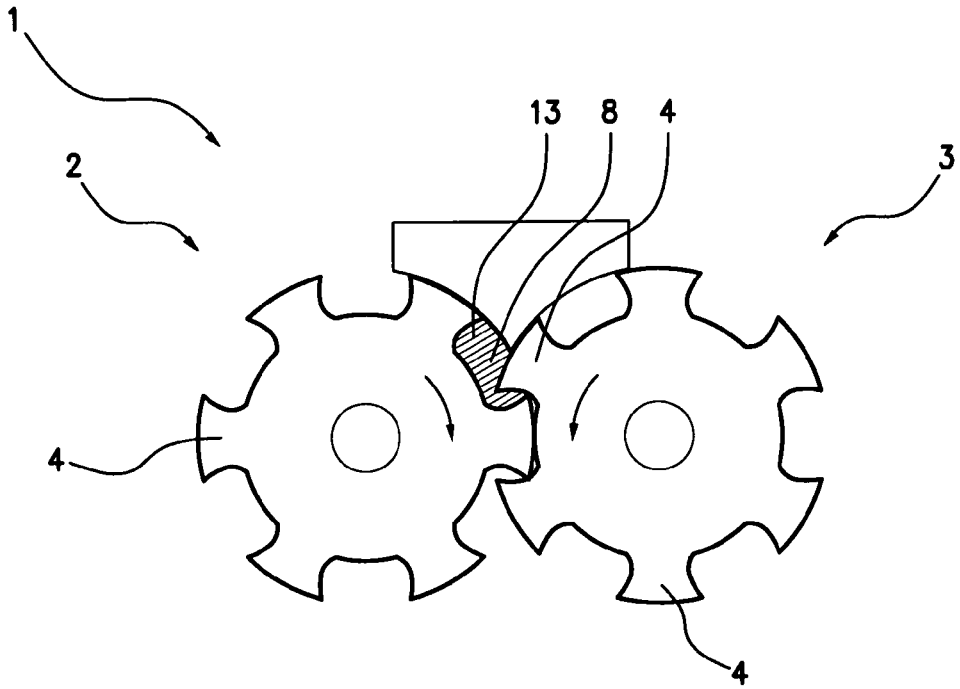
Figure 6C:
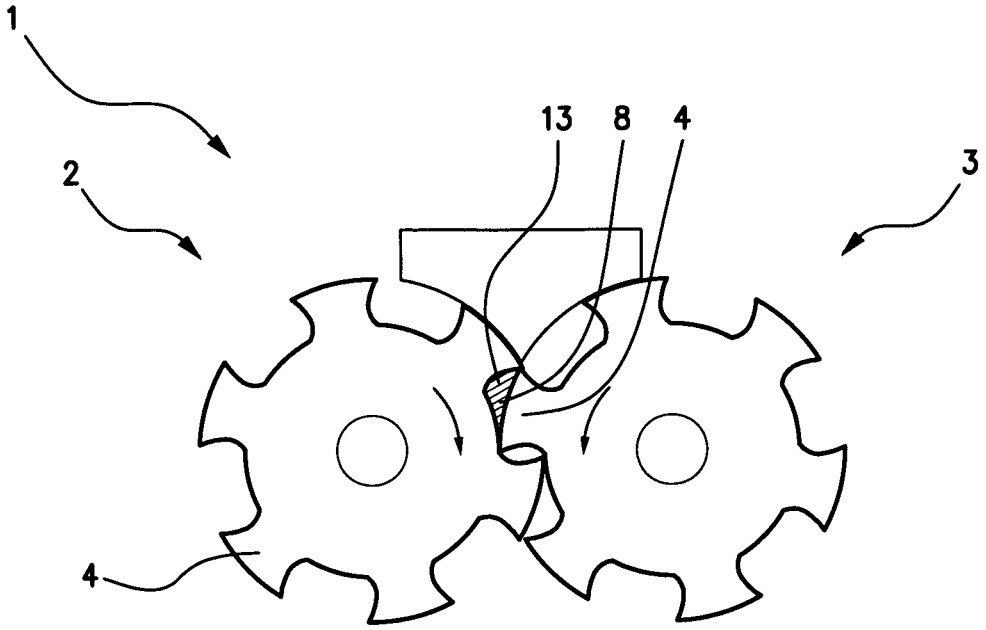
Figure 6D:
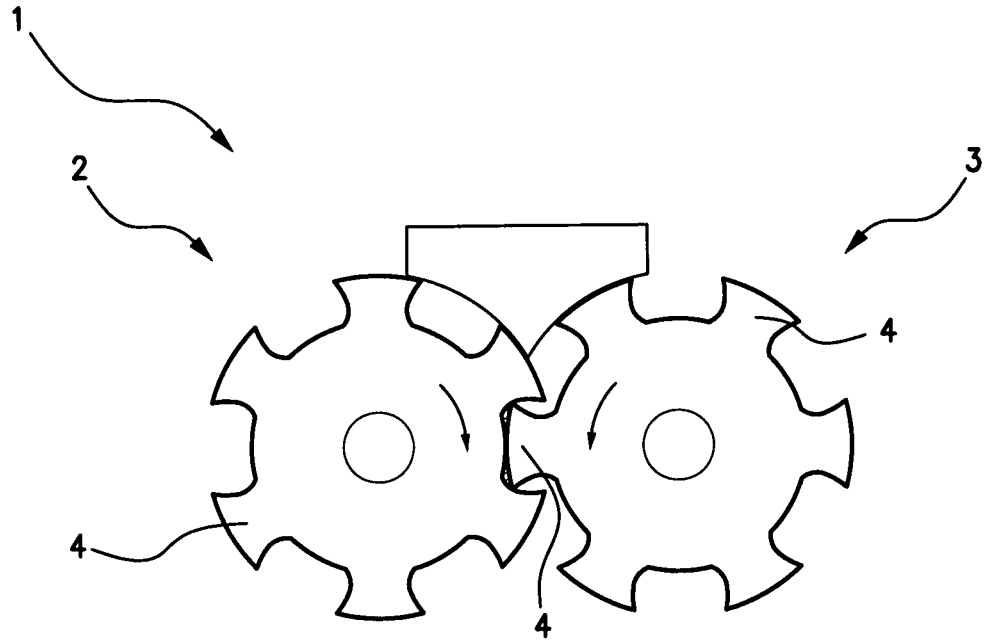

With the compression stroke defined in degrees of rotation, the stroke sequence shown in FIG. 6 starts at 0 degrees (shown in FIG. 6A) and completes at 45 degrees (shown in FIG. 6D). The stroke is comprised of two stages; the first stage of compression occurs between 0 and 30 degrees of rotation while the second stage occurs between 30 and 45 degrees of rotation. A 15 degree overlap of each stroke exists and thus one 360 degree revolution involves twelve individual compression strokes. The sequence is as follows:

- FIG. 6A: 0 degrees rotation—no compression. The volume of gas is now sealed in compression chamber 8 but as yet no compression is occurring.
- FIG. 6B: 15 degrees rotation—stage 1 of the compression cycle has Commenced. The rotor protrusion 4 from the rotor 3 is imposing on the volume of the open portion 13 of the compression chamber 8 causing compression.
- FIG. 6C: 30 degrees rotation—stage 1 is now complete. At this point the compression ratio is 2:1. As the rotors move beyond 30 degrees the second stage of compression begins. It should also be noted that the overlap of compression strokes begins at this point.
- FIG. 6D: 45 degrees rotation—stage 2 of the compression cycle is now complete and the stroke has reached the maximum point of compression.

Figure 7A:
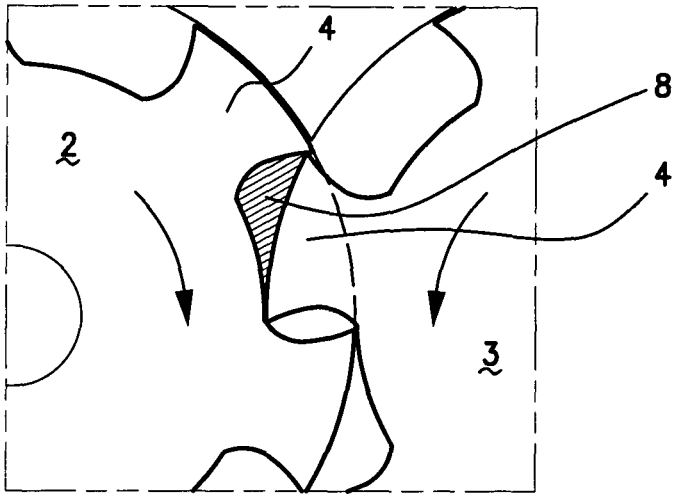
Figure 7B:
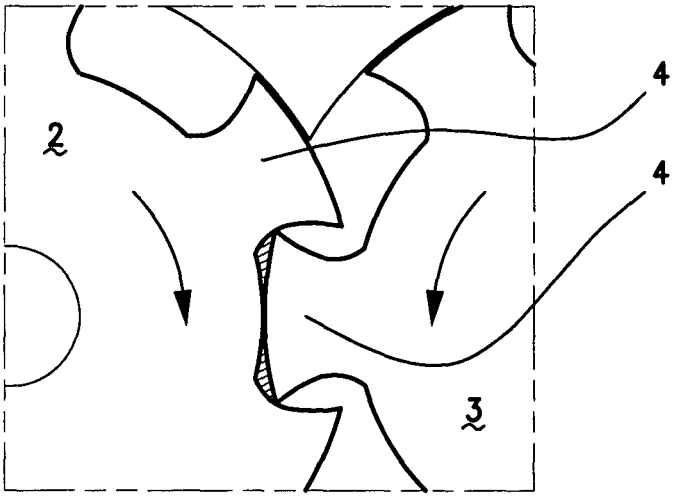

The estimation of the potential compression ratio is based on a two stage compression stroke as shown in FIGS. 7A and 7B. The compression ratio of the first stage (shown in FIG. 7A) is estimated to be in the order of 2:1, and the second stage (shown in FIG. 7B) of compression is estimated to be approximately 4.5:1. Furthermore, the initial stage of compression is believed to have a multiplying effect on the second stage resulting in a final compression ratio of approximately 9:1. The rotor profile contributes to the compression efficiency whereby variations to the geometrical form of the protrusion 4 (i.e, side surfaces 4*a*, projecting end surfaces 4*b*, tips 4*c* and rotor surface 4*d*) will influence the compression ratio.

Normally, combustion takes place slightly before maximum compression (or top dead centre), which is shown is FIG. 2. However, where combustion will take place can be varied greatly, for example depending on whether a vehicle powered by the engine is accelerating, decelerating, idling etc. Typically, combustion will take place at between about 25° and 5° before top dead centre. Accordingly, fuel must be injected by a fuel injection device (not shown) into the compression chamber 8 (now serving as a combustion chamber) at some time before combustion is to take place. The fuel injection device (such as a fuel injector) can take a variety of forms. These forms are known in the art. However, typically an electronic fuel injection system will be used.

When combustion is to take place, a spark must be provided by an ignition device 9. The ignition device 9 will generally be a spark plug. It will be understood however, that the ignition device can take a variety of forms provided it is capable of igniting the fuel within the respective compression chambers 8. The ignition device 9 can be located in various positions. A convenient position is to locate the ignition device 9 inside of the sealing housing 7 at a position which corresponds with the compression chamber 8 at the time when combustion is desired. This can be on either side of the protrusion 4. Alternatively the ignition device 9 could be located on the rotor 2 or 3, or on the protrusions 4. It will be understood that spark plugs would typically be screwed into the sealing housing 7 from the outside of the sealing housing 7 and the spark plug would not protrude beyond the internal surface of the sealing housing. It will be understood that if the sealing housing 7 touches the rotors 2,3 and the protrusions 4, this will depend on the placement of the respective ignition device(s) 9. It will be clear that the fuel injector device can also be located in various positions including, inside the sealing housing 7, or on the rotor 2 or 3, or on the protrusions 4. The most convenient position is once again inside of the sealing housing 7. It will be understood that, as with the ignition device(s) 9, it will be necessary for the fuel injector to be located such that it does not protrude internally from the sealing housing 7 wall.

Figure 8:
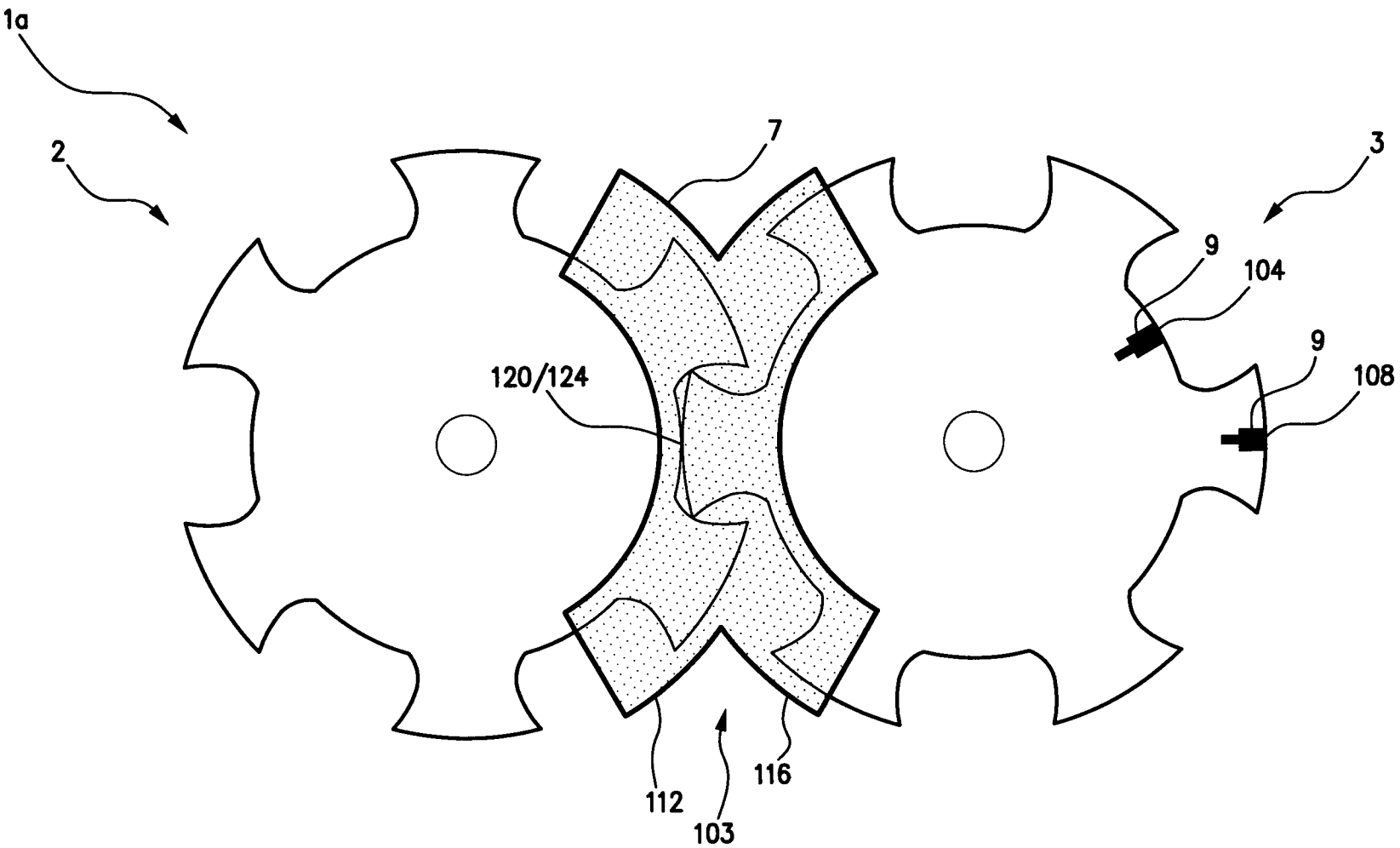
FIG. 8 is a part cross-sectional view of a further form of the rotary device when arranged as a rotary engine illustrating locations for the placement of fuel injectors and/or ignition devices.

With reference to FIG. 8, fuel injection devices and/or ignition devices 9 may be mounted on the top or bottom faces of sealing housing 7 adjacent to appropriate compression chamber 8 positions as follows:

- fuel injectors and/or spark plugs may be mounted on the rotor face 4*d* and projecting end surfaces 4*b*, for example at positions 104 and 108 respectively;

fuel injectors may be mounted on the leading face, for example at positions 112 and 116 of the face 103 of sealing housing 7;

fuel injectors and/or spark plugs may be mounted on the top or bottom of the sealing housing 7, for example at positions 120/124 which are adjacent to respective compression chambers 8.

Combustion results in the warming of the air in the compression chambers 8 and also a change in the chemical structure of the particles within the compression chamber at the time of combustion. This means that the force of expansion of the compressed and ignited air and fuel mixture is greater than the force required to compress the air and fuel (depending on when it was injected). Accordingly, when combustion takes place, the rotors 2,3 continue turning and most of the force created by combustion forces the rotors 2,3 to rotate faster in the direction in which they were already turning.

As the two rotors move in their respective directions (see FIG. 6), ambient air from the intake areas $A_2$ and $A_3$ (shown in FIG. 3) moves into the compression chambers 8. Fuel is then be injected into the compression chamber 8 and the fuel/air mixture continues in the compression process. At a point close to maximum compression, the mixture is ignited. As the mixture burns and builds up pressure, it exerts force on the boundaries of the compression chamber 8 increasing the volume of the chamber. By forcing an increase in the volume of the compression chamber 8, large levels of torque are applied in the already established direction of rotation. Exhaust gases from the spent combustion cycle are passed from the compression chamber 8 to the exhaust areas $E_2$ and $E_3$. Exhaust gasses at this point will follow a straight trajectory once released from the compression chamber 8 and therefore will evacuate the relevant rotor open portion 13. The resultant torque, or turning power produced in the compression chamber 8, will drive the next volume of fresh air into the next compression chamber 8, and therefore the cycle continues.

For part throttle applications, torque or power production can be varied in a number of ways as follows. One approach is to reduce the pressure in the compression chamber 8 causing less fresh air to be delivered for final compression. Therefore, less fuel will be required to be injected to make up the correct fuel air ratio. This reduction in the internal pressure of compression chamber 8 can be achieved by providing variable valve openings or ports in face 103 of the sealing housing 7 to reduce pressure build up in the compression chamber 8. Another way of reducing internal pressure in the compression chamber 8 is to provide solenoid activated plate valves in face 103 of the sealing housing 7.

A further method involves using dynamic compressor units to assist with air supply and exhaust. For example, two compressor units (one compressor unit associated with each rotor) may be arranged to supply intake air directly into the intake sector, and two further compressor units (one compressor unit associated with each rotor) may be arranged to draw air/gases directly away from the exhaust sector. All of the fresh air intakes for the intake sector and exhaust evacuation can be drawn through separate throttle bodies and can be made to be subject to throttle body manipulation. The intake sector compressor units supply air to the intake sector from the pressure side of the compressors allowing pressure in this area to be varied. The exhaust sector compressors empty the exhaust sector from the vacuum side of the compressors allowing vacuum in this area to be varied. Vacuum generation in a respective open area 13 in the exhaust sector will be passed through to the intake sector upon rotation of the rotors. Control of intake and exhaust sector throttle bodies will enable a wide range of pressure variation from vacuum to higher pressure in the intake sector which will accommodate a range of applications from low to high load.

Another method involves using a sequential injector shutdown to vary the number of power stages from twelve (when using 6 protrusions per rotor) per revolution to any number less than 12. Full load would require 12 power stages per revolution, while lower load requirements would dictate correspondingly lower numbers of power stages per revolution. Energy invested in the compression stage of a "non injection" event would be reclaimed in the expansion of the compression chamber 8.

It will be understood that the above described methods for varying power production for varying load requirements could be used individually or in combination.

The compression chamber 8 could also be arranged so that pressures are sufficiently high enough so that compression ignition fuels such as diesel could be used. In this arrangement, part load operation would be achieved through the normal diesel engine load control process of leaning off injectors to lower power output. Diesel engines do not require a reduction in compression chamber 8 air filling to reduce power output; they just reduce the amount of fuel being injected. Such an arrangement could therefore use the normal "fuel lean" operation and require no other throttling down procedures.

The friction created by the parts of the rotary device 1 is minimised. Furthermore, energy is not wasted with changes in direction of the major components as is the case in engines which utilise pistons.

The shape of the side surfaces 4*a* of the protrusions 4 on one rotor, relative to the curve scribed by the tips 4*c* of the protrusions on and the other rotor, creates a constant point of contact at all stages in the formation and dissociation of the compression chamber 8, thereby facilitating sealing of the chamber via an apex- or edge-seal.

Figure 11:
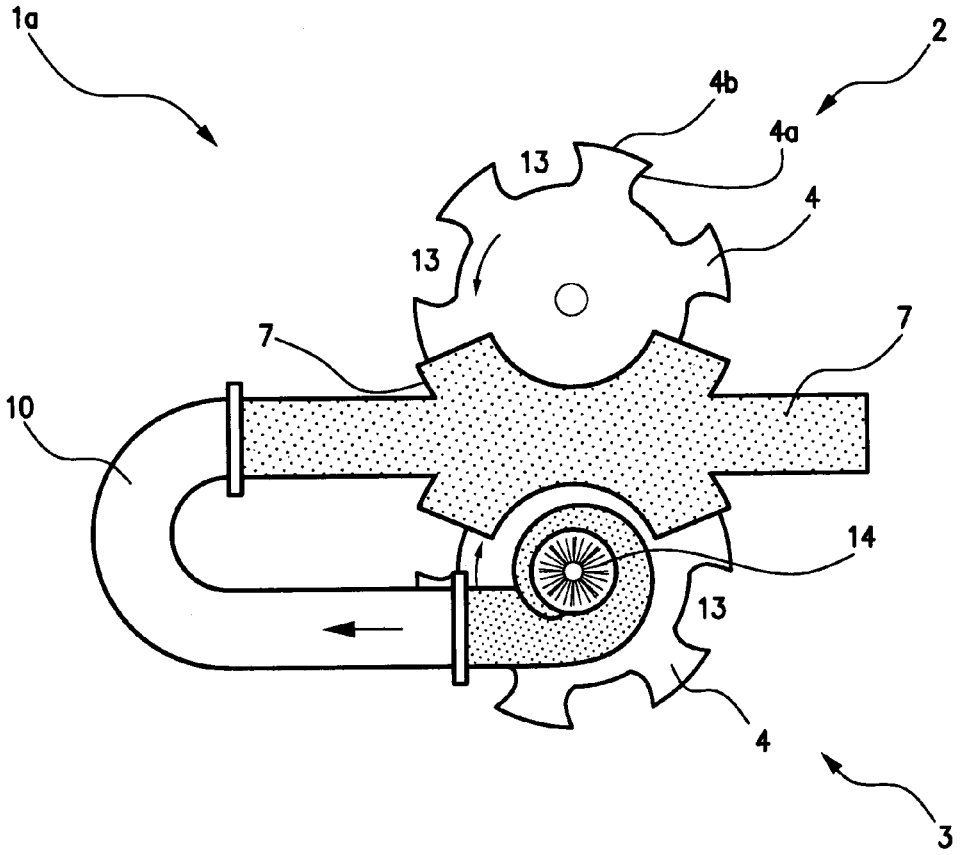
FIG. 11 is a part cross-sectional view of the rotary engine of FIG. 8 showing a further form of centrifugal compressors and an alternative sealing housing.

The sealing housing 7 also includes an air flow channel 10 (see FIG. 11). The air flow channel 10 is arranged to introduce air into the sealing housing 7 and therefore also the compression chamber 8.

The sealing housing 7 also enables the exhaust from combustion to be removed from the vicinity of the rotary engine 1*a*. In some embodiments, an exhaust channel 15 may be provided. The introduction of fresh air into the compression chambers 8 assists in maximising the energy obtained from combustion.

The air flow channel 10 can be used to provide compressed air to the compression chambers 8 thereby providing a forced induction rotary engine as shown in FIG. 11. This may be achieved by providing a centrifugal compressor unit 14 arranged with the air flow channel 10 so that air can be supplied to the compression chamber 8. The centrifugal compressor 14 is merely one method of providing compressed air to the rotary device/engine 1/1*a* via the air flow channel 10. It is also possible for the air compressor unit 14 to be independently powered.

The provision of compressed air means that the compression in the combustion chambers 8 is even greater and accordingly, the forces driving the rotors 2 and 3 is increased.

Figure 9:
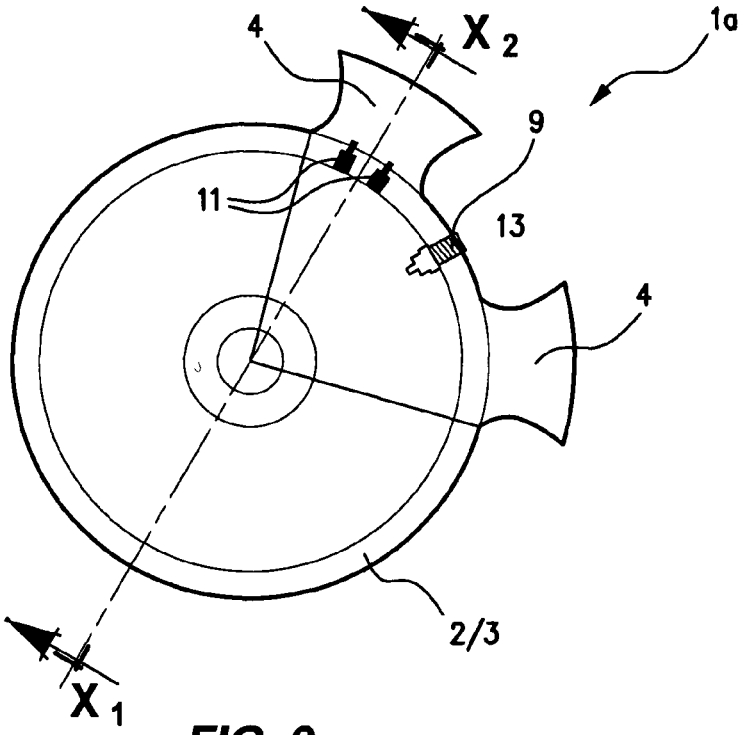
FIG. 9 is a part cross-sectional view of a rotor of the rotary device of FIG. 8.
Figure 10:
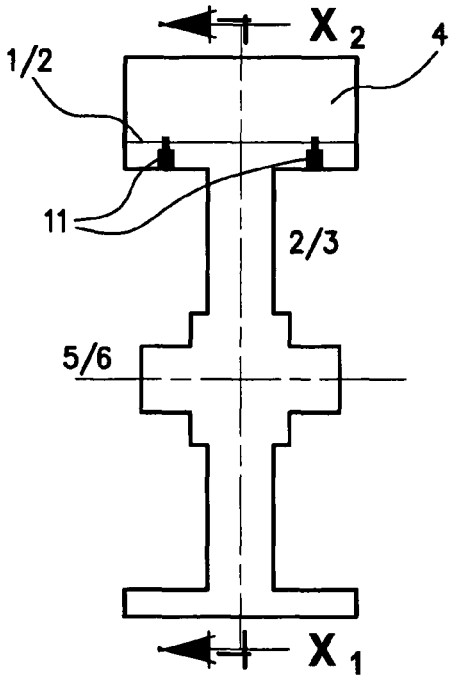
FIG. 10 is a cross sectional view $X_1$-$X_2$ of the rotor of FIG. 9.

The protrusions 4 may be attached to the rotors 2 and 3 by bolts or screws 11 as shown in FIGS. 9 and 10. It will be understood that the method of attachment is not critical provided that the protrusions 4 are securely attached to the rotors 2 and 3. It is possible for the rotors 2 or 3 and the protrusions 4 to be integral (ie. made as a single piece). With reference to FIGS. 9 and 10, each protrusion 4 is attached to their respective rotor 2 or 3 by four bolts or screws 11. The circumference of the rotors 2,3 can be shaped to provide a surface 12 for the easy attachment of the protrusions 4.

Figure 12A:
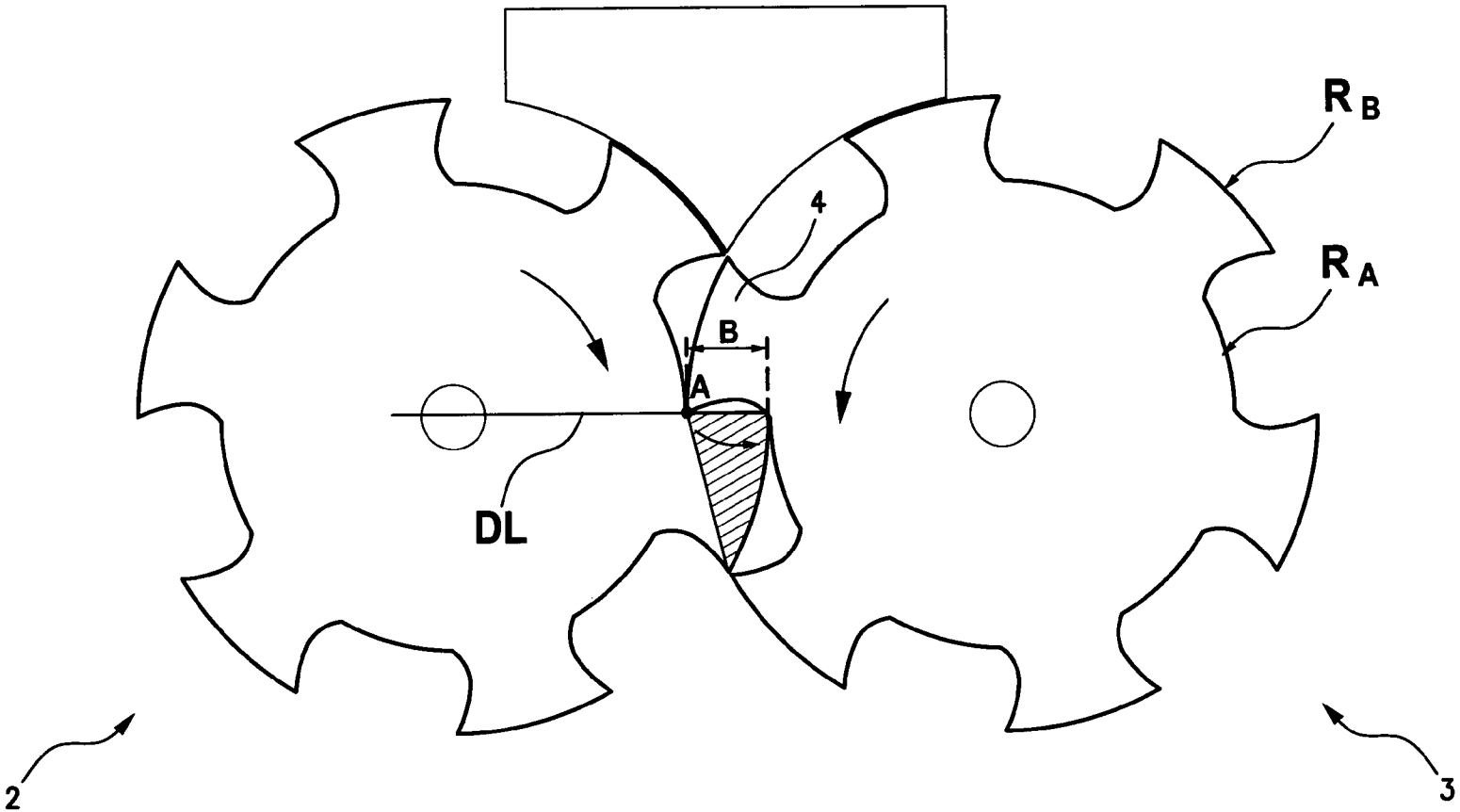
FIG. 12A shows the apex tip 'A' resting on a datum between the two rotors for use in calculating the curvature of the faces bounding the open areas of the protrusions.
Figure 12B:
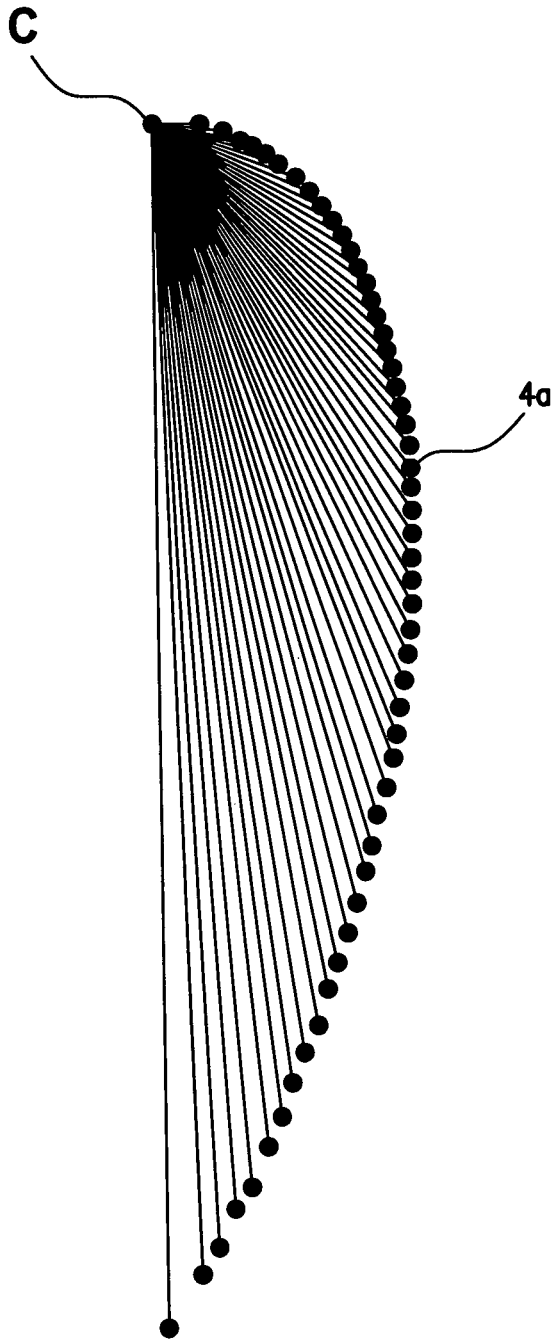
FIG. 12B shows a completed profile for a side surface for one embodiment of a respective rotor protrusion.

The respective axes 5/6 of the rotors 2,3 are supported by bearings (not shown). This ensures the smooth rotation of the rotors 2,3. The profile of the curved surface 4*a* of a respective protrusion 4 can greatly influence the operation of the rotary device/engine 1/1*a*, and can vary for different compression requirements. With reference to FIGS. 12A and 12B, the profile of the respective curves may be generated by first defining an apex 'A' (tip 4*c*) of a protrusion 4' of rotor 3 on a datum 'DL' drawn as shown. This apex point 'A' assumes a set depth of the protrusion 4. An initial straight surface is created radially from the centreline of rotor 2 centreline. The shaded portion of rotor 2 is 'squared off' as a blank protrusion for which point 'A' of rotor 3 will pass through as both rotors rotate simultaneously.

The next step is to plot the trajectory of apex point 'A' through the opposing (squared and shaded) protrusion 4 of rotor 2. Using current precision machining processes, an accuracy of ±0.5 degrees can be achieved, so an angle of this order can be used as a baseline increment for plotting the required profile. The cumulative angle and distance of apex point 'A' from its starting point is therefore overlayed through to create the trajectory profile.

FIG. 12B presents the resulting curved profile of side surface 4*a* required. When point 'C' is positioned on the original point 'A' start position, the exact location of the curve of side surface 4*a* can be identified.

Figure 5:
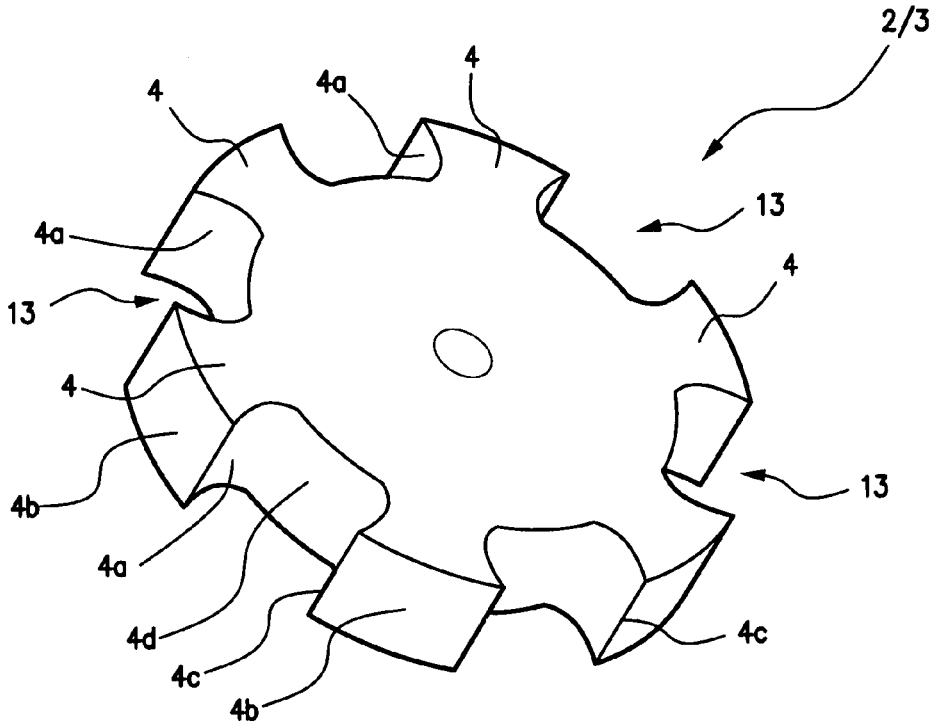
FIG. 5 shows a perspective view of the rotor shown in FIG. 4.

Once each protrusion 4 has been created from a pair of side surfaces 4*a*, the rotor profile is completed by linking each curve with a circular arc indicated by radius $R_A$ and radius $R_B$. The complete profile can then be expanded to a fixed width as shown in FIG. 5. The profile can then be used as direct input to a computed numerically controlled (CNC) machine for manufacturing the rotors.

In order to illustrate the concept of the present invention in the figures, only 6 protrusions per rotor have been shown. It will be appreciated that any number of protrusions per rotor can be used. The number of protrusions can be used to manipulate the shape of the combustion chamber and therefore achieve different output characteristics. The height of the protrusions (or the ratio of radius $R_A$ to radius $R_B$ in FIG. 12A) can also be changed to vary the shape of the combustion chamber 8. Any of these combinations can be used with present invention. Once the number of protrusions per rotor and the ratios of radius $R_A$ and radius $R_B$ are chosen, the curve of the side surfaces 4*a* can be generated. The combustion chamber 8 shape can also be manipulated by changing the shape of the rotor face 4*d* and the projecting end surfaces 4*b*. Altering each radius or changing from a convex radius to a concave radius will change the compression ratio which will be important for different applications of the invention.

Figure 13:
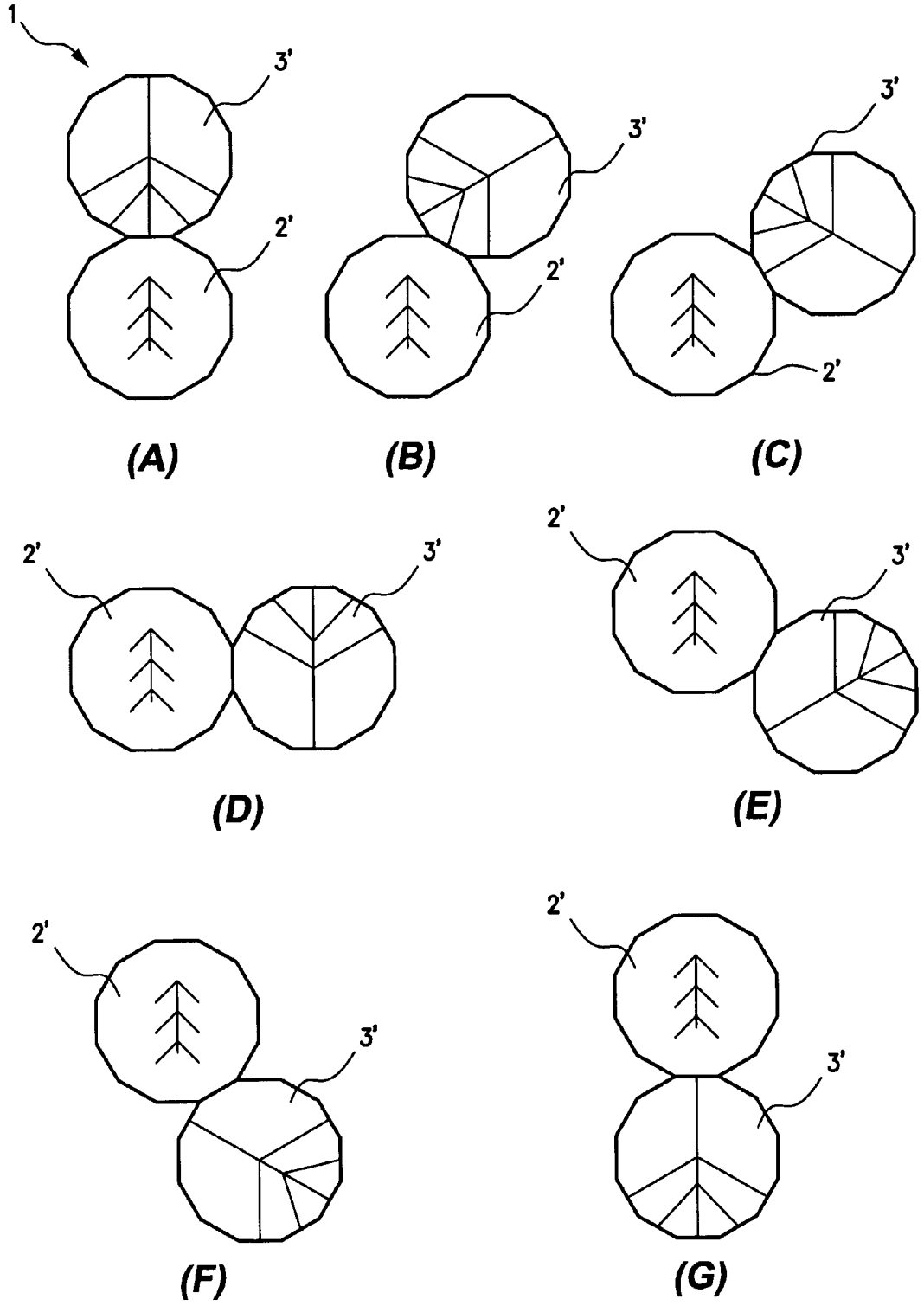
FIG. 13 is a sequential movement diagram of the movement of one rotor relative to the other.
Figure 14:
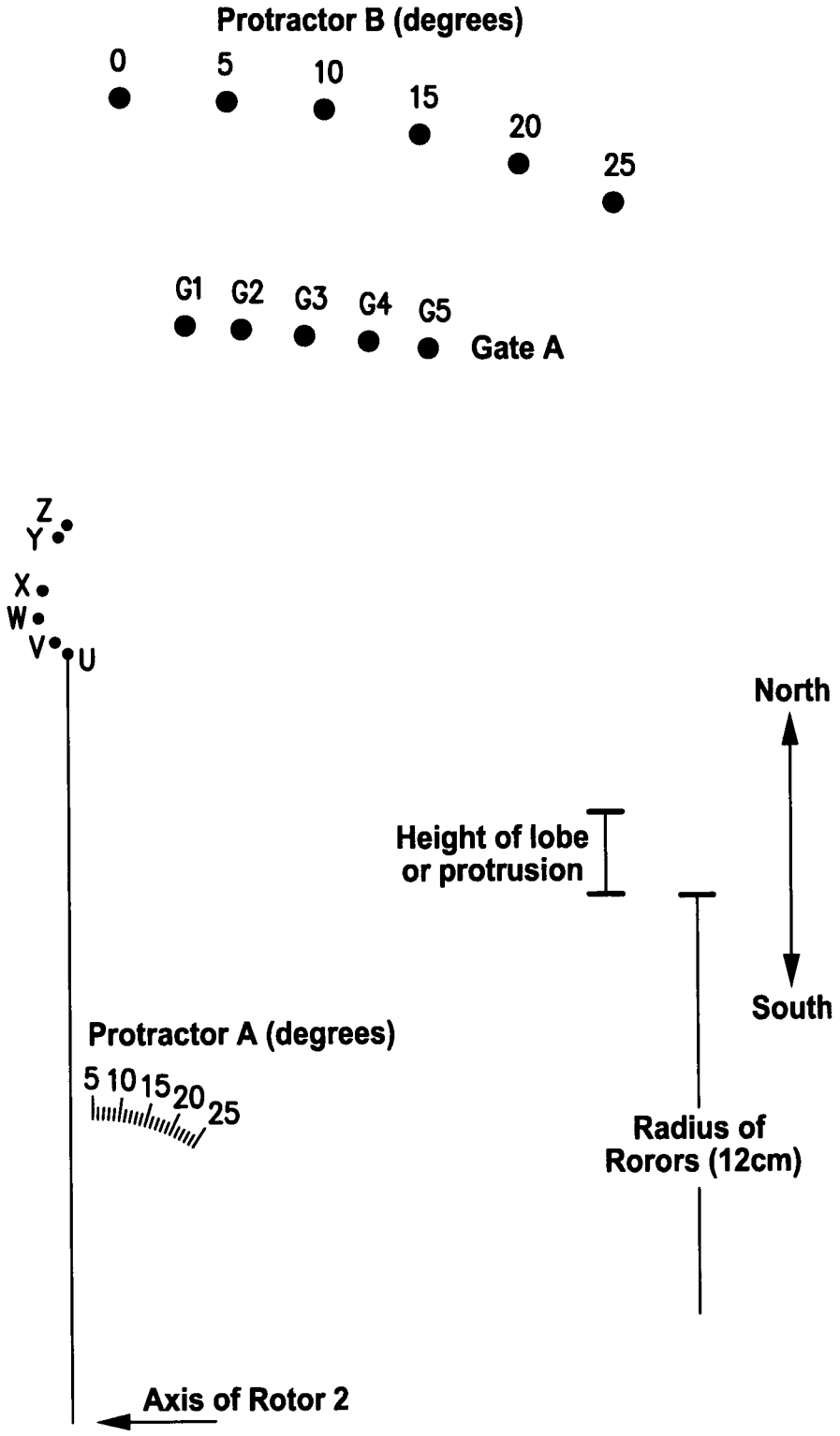
FIG. 14 shows an alternative method of plotting the curve of side surface 4*a;*

With reference to FIGS. 13 and 14, illustration of another method for the calculation of the side surfaces 4*a* is shown and described as follows.

In FIG. 13 one of the rotors 2' is held about a stationary axis and the other rotor 3' is allowed to move. As will be apparent from the sequences 7/1 to 7/7, rotor 3' has, in the course of scribing 180 degrees relative to rotor 2', rotated about 360 degrees about its own axis.

If the rotor 2' is fixed, rotor 3' will always rotate about its own axis twice the number of degrees that it rotates around the axis of rotor 2'.

FIG. 14 is an example of how to plot curve U-Z for curve 4*a* through points U, V, W, X, Y, Z. The line between the axis of rotor 2' and point U is the radius of rotor 2'.

If the rotors were orientated such as those in FIG. 13/1, then the radius of rotor 3' would be a line between point Z and 0 degrees (zero degrees) on protractor B, this line would of course be 12 cm, the same as rotor 2' radius. The protrusion height in this example is 2 cm, ie. the shortest distance between points U and Z.

FIG. 14 illustrates the idea that given that rotor 2' is held still, any number of degrees that the axis of rotor 3' moves to the right (relative to the axis of rotor 2'), rotor 3' will rotate on its own axis twice that number of degrees.

Take for instance in FIG. 14, a hypothetical line between the axis of rotor 2' and the momentary axis of rotor 3' (0 degrees on protractor B). The radius of rotor 3' which followed between the points Z and 0 degrees on protractor B is parallel with the north-south line. Add to this line the distance or height 2 cm of the protrusions and point U is established. The length of the hypothetical line between point U and 0 degrees on protractor B is 14 cm, (total height of radius of the rotor plus protrusion).

If this hypothetical line pivots on the axis of rotor 2', say move it 5 degrees to the right (through protractor A or B), the axis of rotor 3' now becomes momentarily, the 5 degree point of protractor B. The axis of rotor 3' has now moved 5 degrees to the right relative to the axis of rotor 2'. As that rotor 3' must have rotated twice that number of degrees on its own axis, therefore 10 degrees is scribed.

When the axis of rotor 3' is at the 5 degree point on protractor B, the hypothetical line (originally 0 degrees on protractor B to point U), must now be at 10 degrees to its original north-south orientation. Its distance or length is still 14 cm. This hypothetical line now runs from the 5 degrees point on the protractor B, through G1 on Gate A (just a 10 degree reference point from the north-south orientation) for 14 cm and ends at point V.

The same method is used to create points W, X, and Y. At the 10 degree point on protractor B, a hypothetical line is drawn for 14 cm at an angle of 20 degrees (to its north-south orientation) through G2 and ends at point W. Point Z is merely the point at which the protrusions either begin or end contact.

Plotting a large number of these points between U and Z would define more clearly the curve U-Z, which replicates the concave shape of the side surface 4*a*.

The ratio of the height of the protrusions to the base rotor radius ratio is completely variable in this rotary device. Any suitable ratio can be considered, so long as a compressed volume results. However, the longest duration of compression is desired to maximise compression in any given scenario, and the number of protrusions per rotor and the protrusion height to radius ratio both have an effect on the resulting compression ratio.

The following sets out two examples:

Example 1

5 protrusions per rotor (10 protrusion spaces per rotor)
36 degrees per protrusion from rotor axis
protrusion height to base rotor radius ratio is 25/40
compression ratio ⇒ ≅3.6:1

Example 2

6 protrusions per rotor (12 protrusion spacings per rotor)
degrees per protrusion from rotor axis
protrusion height to base rotor radius ratio is 9/24
compression ratio ⇒ ≅4.6:1

The rotary device 1 can also be used as a compressor unit. With reference to FIGS. 18, 19, 20 and 21, an embodiment of a rotary compressor 30 is shown. Much of the rotary compressor 30 are similar to the rotary engine assembly (reference 1*a*) described above. However, instead of having fuel injection and ignition devices located adjacent the combustion chamber (now acting as a compressible chamber 8*a*), one or more one-way valve(s) or port(s) will be located adjacent the compressible chamber 8*a*. Preferably, the one-way valve (s) are located adjacent the compressible chamber 8*a* at a position where the chamber is at its smallest. In this way the one-way valve(s) facilitate the exit of gas from the compressible chamber 8*a*. The compressible chamber 8*a* decreases in volume, hence the displacement of gas from the compressible chamber out through the one-way valve(s).

Gas which exits the one-way valve(s) is collected in a collection device. As more gas is forced into the collection device, the gas in the collection device is compressed. This compressed gas may be stored for use as required.

Once again it is possible for the sealing housing 7 to be used and for the one-way valve(s) to be located in the sealing housing 7, or in one or both rotors 2,3. The sealing housing 7 abuts the rotors 2,3 and their respective protrusions 4 to seal each of the compressible chambers 8*a*. It is also possible to introduce compressed gas into the compressible chamber 8*a* as described above, for further compression.

For the embodiment of the rotary compressor 30 shown in FIGS. 18, 19, 20 and 21, the compressor 30 comprises an electric motor 35 arranged to drive the compression cycle. The electric motor 35 is arranged so as to be speed controlled to achieve the required compressor RPM. The compressor 30 has both rotor shafts 5*a*,6*a* of respective rotors 2,3 connected using a gear train 40 arrangement (shown in FIG. 21) having an arrangement of gears to ensure correct rotation of the rotors 2,3. Taking into consideration packaging size, a 4 gear layout is considered readily adaptable for use with the rotary compressor 30 shown.

Figure 21:
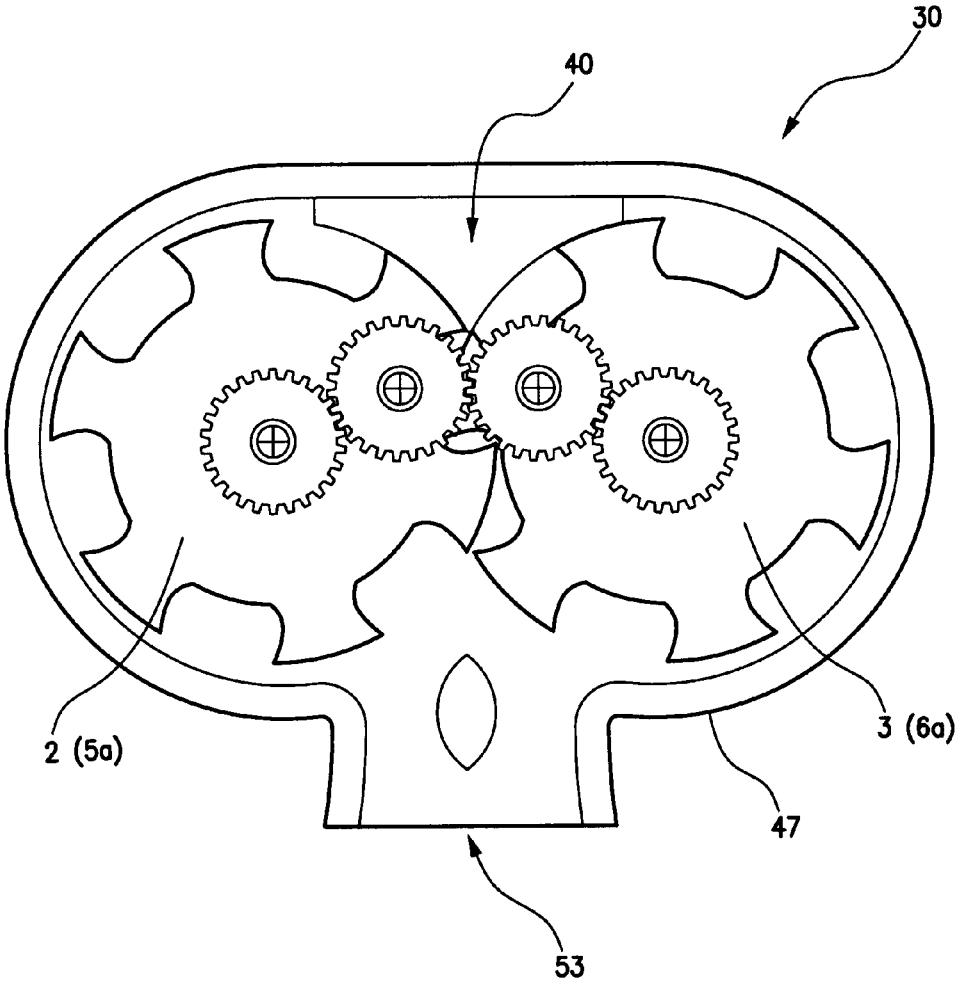
FIG. 21 shows a part cross-sectional view of the gear train arrangement incorporated within the compressor of FIGS. 18, 19 and 20.

Connection between the electric motor 35 and the gear train 40 is via a toothed belt 45 arranged external to the gear train as shown in FIG. 21. The compressor 30 is housed within a primary compressor housing 47 and the gear train 40 is housed within a gear box housing 49 having a gear box closure 51. The compressor 30 further comprises an air intake region 53 and one or more air exhaust valves 55.

Figure 22A:
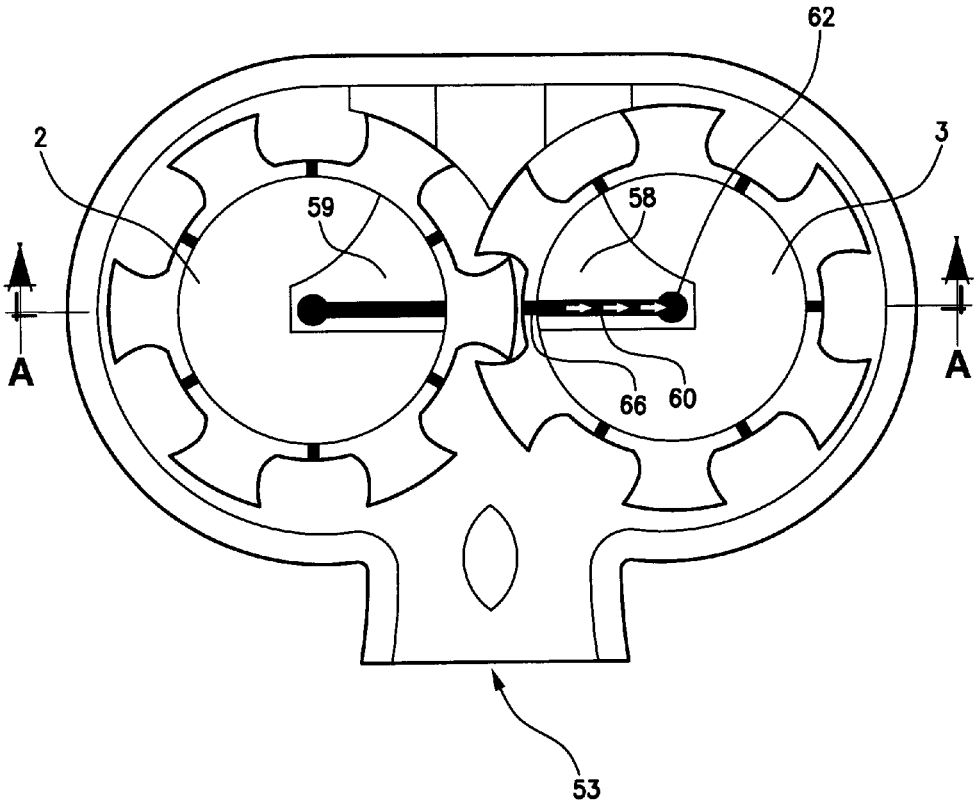
FIG. 22A shows a part cross-sectional view of one embodiment of a valve assembly for use with various forms of the rotary device of the present invention
Figure 22B:
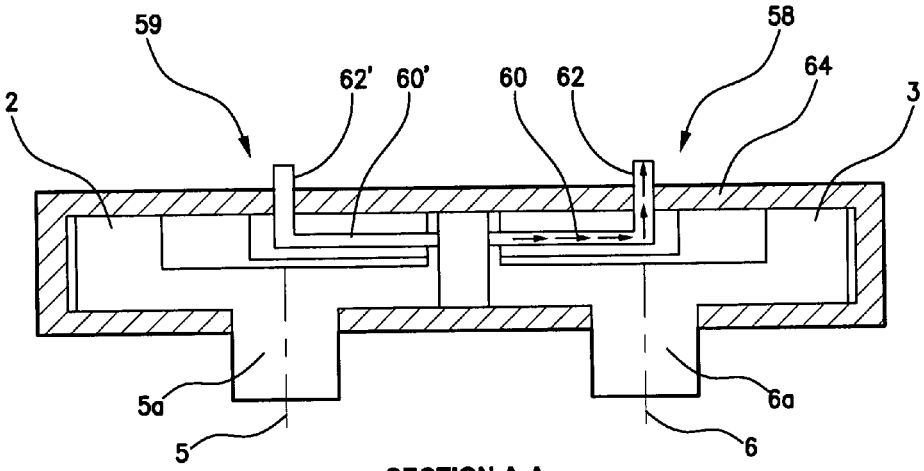
FIG. 22B shows a view through section A-A of FIG. 22A.
Figure 23A:
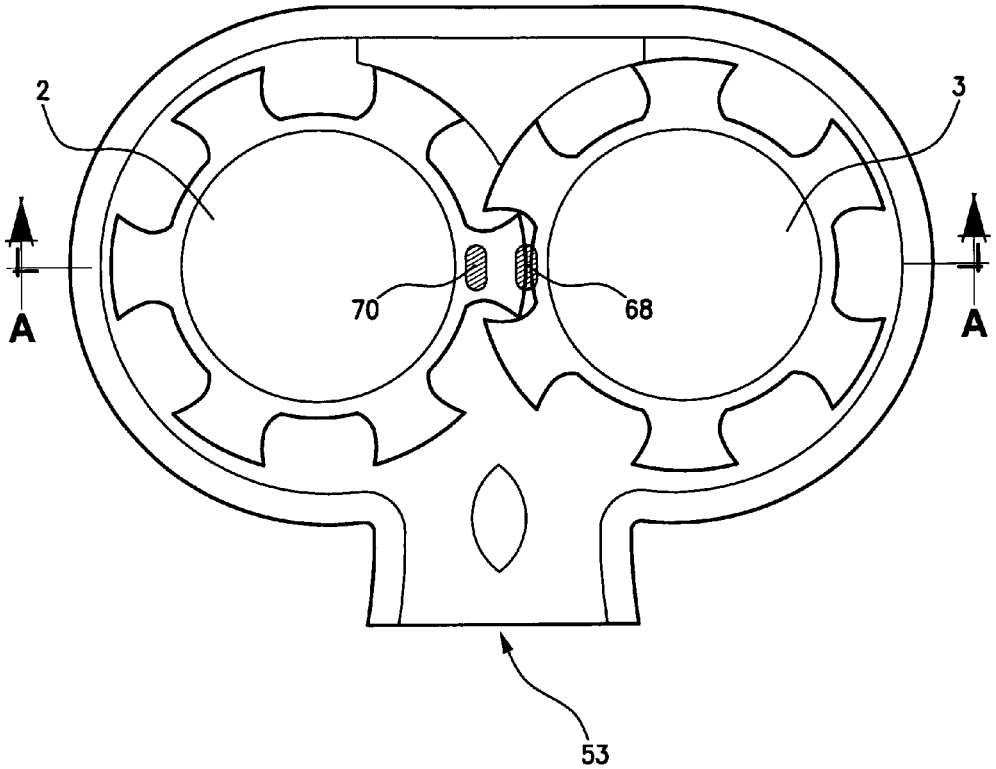
FIG. 23A shows a part cross-sectional view of another embodiment of a valve assembly for use with various forms of the rotary device of the present invention.
Figure 23B:
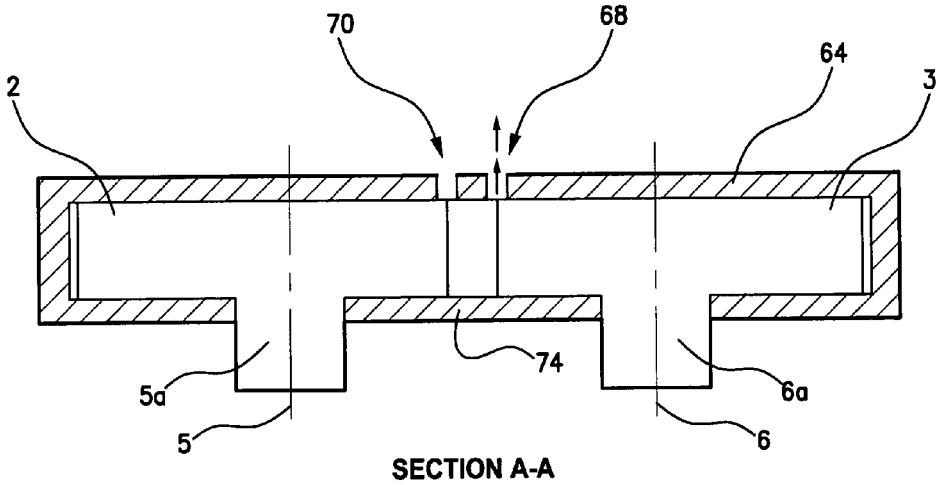
FIG. 23B shows a view through section A-A of FIG. 23A.

Various valve/port arrangements and combinations shown in FIGS. 22 and 23 can be applied to various embodiments of the rotary device 1 as required, depending on the particular application. For example, one-way plate valves can be used in both side valve (shown in FIG. 23) or internal valve configurations (shown in FIG. 22), or alternatively when a combination of both types of porting is required. Manufacturing cost, efficiency, desired pressures and unit size are all factors for consideration when determining which valve/port combinations would be appropriate for any given application.

FIGS. 22A,B show an example embodiment of internal valve assemblies 58 and 59. For the situation shown, internal valve assembly 58 is arranged to be open in an exhaust condition and internal valve assembly 59 is closed. Internal valve assembly 58 consists of a transfer channel 60 placed in the rotor 3, and a corresponding transfer channel 62 mounted to the top plate 64 allowing high pressure air to be transferred out of valve 66 provided in rotor surface 4*d* of rotor 3. This arrangement allows the port timing and duration to be controlled independently of the rotor profile.

FIGS. 23A,B show an example of one embodiment of a side valve assembly 66 in which ports 68 and 70 are provided in the top plate 64. The ports 68 and 70 are arranged to open and close as the rotors 2,3 rotate and obscure/un-obscure the ports in turn. Variations in the port position, shape and rotor profile allow the port timing and duration to be controlled. The ports 68, 70 may also be provided in the bottom plate 74. Alternatively, the ports 68, 70 may be provided in both the top 64 and bottom 74 plates.

It is envisaged that small portable compressor units would tend to favour the use of side mounted plate valve assemblies having regard to manufacturing (being simple to manufacture) and weight considerations (being lighter in weight). Large scale compressor units such as energy storage systems for renewable power generation may tend to favour the use of the internal valve assemblies having variable porting duration for increasing efficiency.

Figure 24A:
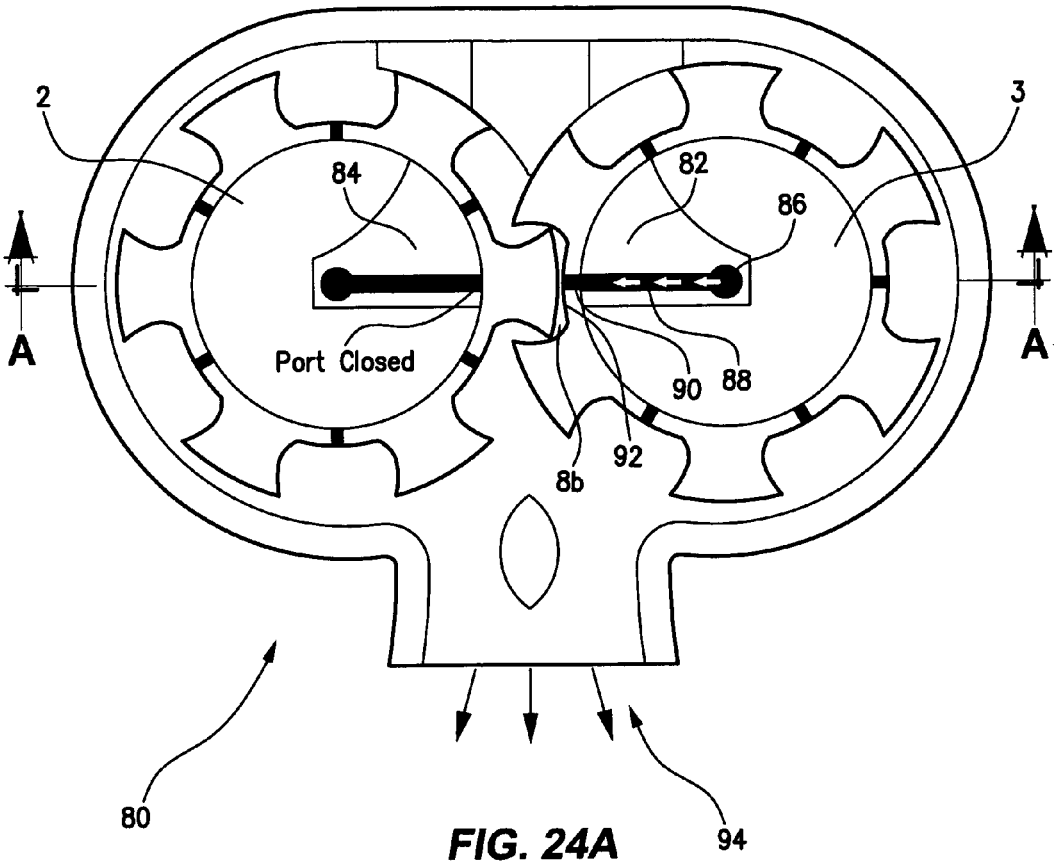
FIG. 24A shows a part cross-sectional view of a further embodiment of a valve assembly for use with various forms of the rotary device of the present invention, along with a view through section A-A.

With reference to FIGS. 24A,B, the rotary device 1 may also be arranged for use as a rotary turbine 80, and is similar in many aspects to the rotary compressor 30 described above, with the exception that the rotors of the rotary turbine 80 rotate in the opposite direction relative to the positioning of the valves/ports. The rotary turbine 80 is arranged to convert gasses under pressure into rotary motion. Contrary to the rotary compressor 30 arrangement, the pressurised gases flow in the opposite direction to the gases in the compressor configuration. Therefore, each of the compression chambers 8 now serves as an expandable chamber 8*b*.

When arranged as a turbine, the rotary device 1 provides a direct and efficient way of converting a pressurised gas into rotational motion for the purposes of electricity generation or vehicle propulsion. Pressurised gas enters the chamber between the rotors when the chamber is at its smallest in volume. The gas pressure forces the chamber to become larger in volume, thus resulting in rotation of the rotors. As the rotation occurs, the pressure in the gas decreases as its energy is used to expand the expandable chamber 8*b*. Initial estimates suggest the gas pressures tend to zero (0 kpa) when the expandable chamber 8*b* gets to its largest volume, with nearly all of the energy stored in the gas pressure transferred to rotor rotation. This represents a highly efficient transfer of energy from pressurised gas/air/steam to mechanical rotation for electricity generation or vehicle propulsion.

Figure 24B:
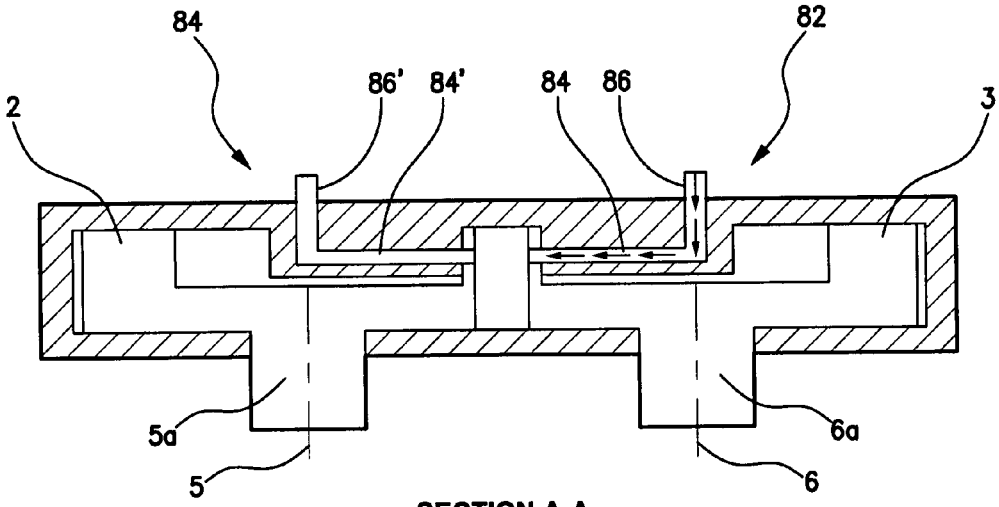
FIG. 24B shows a view through section A-A of FIG. 24A.

The rotary turbine 80 comprises internal valve assemblies 82 and 84, each having an outlet 86 in fluid communication with a transfer channel 88. For the stage of the cycle shown in FIG. 24, the valve assembly 82 is active and the valve assembly 84 is closed.

The gases initially enter the rotary turbine 80 through the internal valve assembly 82. The gases flow through the valve opening 90 in the rotor face 92 in the expandable chamber 8*b* between the two rotors 2,3 when the volume inside the expandable chamber is at its lowest. The pressure of the entering gas acts to expand the expandable chamber 8*b* volume to its greatest, resulting in rotation of the two rotors 2,3. This rotation can then be used to do work such as electricity generation. Exhaust gases are exhausted from the rotary turbine 80 by way of exhaust region 94.

Figure 25:
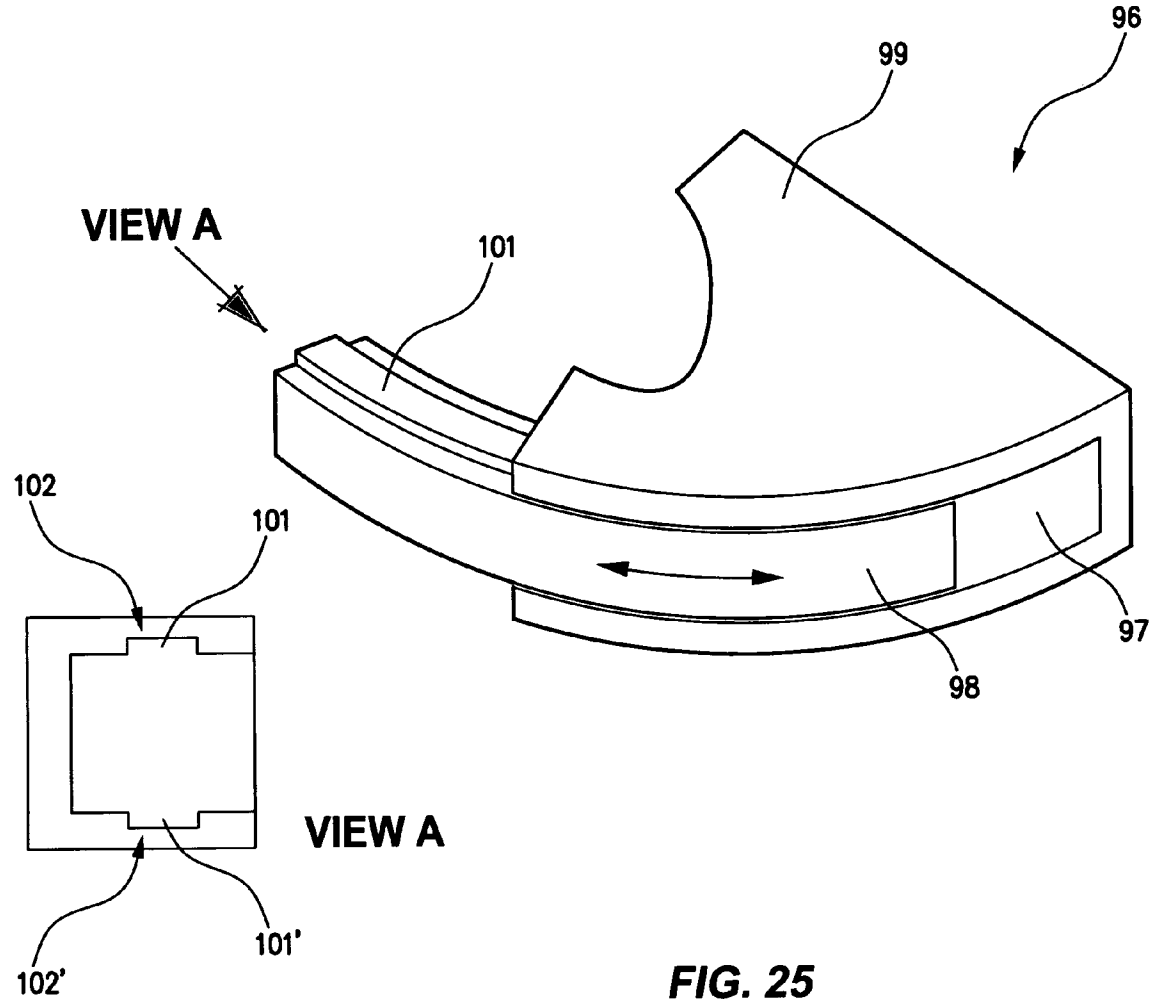
FIG. 25 shows a perspective view of one embodiment of a variable aperture valve arranged to vary the aperture opening of the valve.

It will be appreciated that the aperture opening of respective valves and ports may be arranged so as to be variable. One embodiment of a variable aperture valve assembly 96 which allows an aperture opening 97 to be varied is shown in FIG. 25. The variable aperture valve assembly 96 comprises a sliding valve 98 having ridges 101/101' arranged to slidingly engage with respective complementary grooves 102/102' provided in a housing 99. The variable aperture valve arrangement 96 allows for the timing and duration of the aperture opening 97 to be adjusted to optimise compressor, engine or turbine efficiency.

The turbine arrangement is believed to run efficiently on lower pressures thereby decreasing the need for super-heated steam pressures of current power generators which require large quantities of fuel. The lower pressure requirements of the turbine arrangement is likely to suit electricity generation from steam production particularly in the solar thermal and geothermal sectors. It may also have application to achieve efficiency gains in the coal fired sectors.

A further arrangement of the rotary device 1 involves combining the rotary compressor 30 and turbine 80 arrangements for use as a renewable energy source. An arrangement of this nature can be potentially useful as an energy storage system for renewable energy sources. Wind turbines, solar photovoltaic generators and solar thermal generators can have their intermittent outputs stored as compressed air using rotary compressor arrangements according to that described above. Stored compressed air provides a low cost energy storage facility with little energy loss over short or long time periods, which can then be converted efficiently back to electricity on demand through energy transfer from a rotary turbine arrangement like that described above.

Wind turbines compressing air for energy storage and later conversion to electricity using the turbine arrangement would require minimum energy losses across the valve. Using the internal valve assembly with variable porting duration in both the compressor and turbine configurations would tend to increase the efficiency of energy storage and generation in renewable energy systems.

The turbine arrangement described, when used for electricity generation (from for example steam pressure), may benefit from a non-variable internal valve assembly due to the relatively constant pressures available from steam generated pressure vessels.

Figure 26:
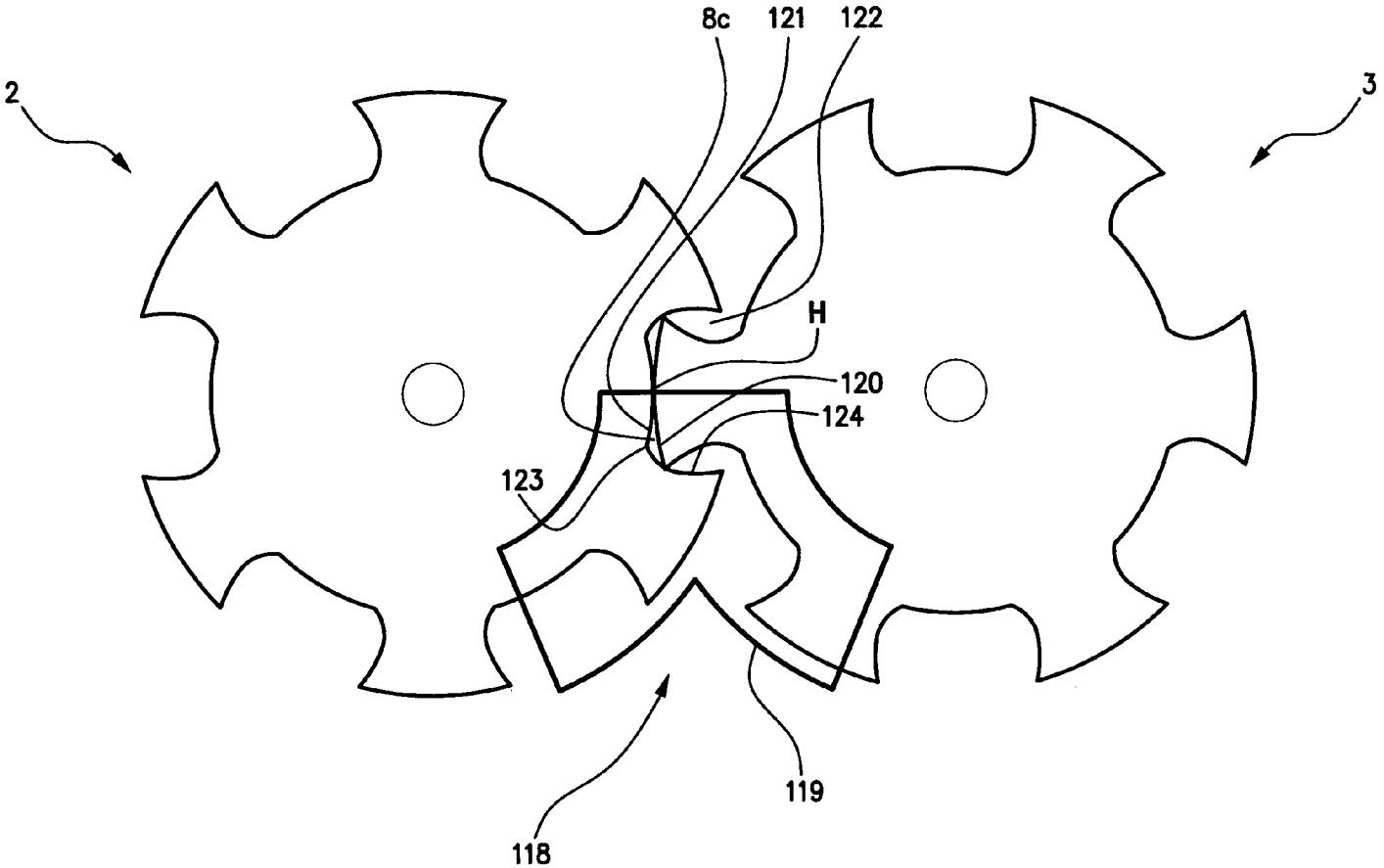
FIG. 26 shows a part cross-sectional view of a further housing arrangement for use with various embodiments of the rotary device of the present invention.

A further housing arrangement 118 is shown in FIG. 26 which may also be provided for various applications of the rotary device 1 and is a modification of the sealing housing 7 shown in FIG. 3. For the revised arrangement, the housing arrangement 118 is configured having only approximately half of the active chamber 8*c* appropriately housed and sealed. The principal of this 'half chamber' arrangement (hereinafter half chamber housing 119) may apply to the rotary device of both of the compressor 30 and turbine 80 arrangements.

The half chamber housing 119 is premised on the basis that, whilst the protrusion of one rotor is engaging the inside of the opposing rotor open portion 13 volume, the same process is concurrently happening to the opposing rotor. The proximity of the corresponding projecting end surface 120 of protrusion 4 with the opposing rotor face 121 are such that they make an effective seal to stop gasses passing between their respective 'mating' faces. For example, with reference to FIG. 26, the projecting end surface 120 of rotor 3 that is inside the open area 122 of rotor 2 makes an effective seal with the rotor face 121 of rotor 2 thereby forming a gas seal (labelled 'H'). For the instance shown, the chamber 8*c* then becomes the operational chamber. For the arrangement shown, an internal port 123 is provided at or near where the rotor face 121 and the side surface 124 of rotor 2 meet. Such ports are similarly provided on rotor B so that operation is continuous. It will be appreciated that the relative rotations of the rotors and the gas flows through the respective ports will be different (generally opposite) depending on whether a compressor or turbine configuration is required.

A distinctive characteristic of the half chamber housing 119 is that the chamber 8*c*, at its smallest, tends to 'theoretical zero' in volume. If rotor 3 in FIG. 26 was to rotate about 15 degrees in the clockwise direction, it's apex (which makes up one of the corners of chamber 8*c*) would almost contact the region in the rotor face 121 where the internal port 123 is located. At this point, the volume in chamber 8*c* would be close to theoretical zero. The advantage for using the half chamber housing 119 with a rotary compressor configuration is that significant increases in pressure develop in the chamber 8*c*.

The standard rotary design arrangement involves pressure ratios of around 10:1. In contrast, incorporation of the half chamber arrangement is likely to involve pressure ratios significantly greater. The advantage for using the half chamber housing 119 with a rotary turbine 80 configuration is that there is minimal residual volume in the chamber 8*c* to be brought up to the pressure of the incoming gasses. The incoming gases can therefore begin to produce rotational motion (torque) the instant they enter the chamber. This is envisaged to result in a very high level of the energy in the pressurised gases being converted directly into torque.

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention.

The invention claimed is:

1. A rotary device comprising first and second rotors disposed adjacent each other and rotatable about substantially parallel axes of rotation, wherein:

(i) each of the first and second rotors has protrusions extending therefrom at regular intervals about the circumference of each to define an open portion of a sealable compression chamber between adjacent protrusions, the open portion bounded by a chamber surface defined by two side surfaces and a rotor surface joining said two side surfaces;

(ii) each of said protrusions has two side surfaces and a projecting end surface, wherein the meeting point between each of said two side surfaces and the projecting end surface defines a tip; and (iii) the first and second rotors are arranged such that upon contra rotation of the rotors, two tips of a first protrusion of the first rotors engages with a chamber surface between a pair of protrusions on the second rotor, and the two tips of the first protrusion are both in constant sealing contact with said chamber surface of the second rotor for a first period of time so as to form a sealed chamber between the end surface of the first protrusion of the first rotor and the chamber surface of the second rotor to execute a chamber stroke, during which first period of time the volume of the chamber is reduced to a minimum volume level by the contra rotation;

wherein, rotation of motion of the first and second rotors upon contra rotation causes at least one of:

(a) prior to sealing of a sealable compression chamber to form the sealed chamber; ambient pressure is received within the sealable compression chamber; or (b) gas within the sealed chamber evacuates directly to ambient atmosphere at the end of the chamber stroke.

2. The rotary device according to claim 1, wherein the each of said protrusions is shaped so as to achieve a predetermined chamber volume.

3. The rotary device according to claim 1, wherein the shape of the each of said two side surfaces of each protrusions are arranged so that, as the first rotor rotates relative to the second rotor, each of the tips of the projecting end surface of the first protrusion on said first rotor scribes a curve which follows the shape of the side surface of an adjacent protrusion on said second rotor, and forms a constant point of contact between the tip and the side surface throughout an entire stroke.

4. The rotary device according to claim 1, wherein the projecting end surfaces of the each of said protrusions is shaped as a convex curve.

5. The rotary device according to claim 1, wherein each of said two side surfaces of the each of said protrusions are shaped as a:

(i) concave curved surface; or (ii) an exponential concave curve.

6. The rotary device according to claim 1, wherein each of said tips comprises a sealing material for sealing the compression chamber.

7. The rotary device according to claim 6, wherein the sealing material withstands typical compression and combustion pressures.

8. The rotary device according to claim 1, wherein an area in which the compression chamber is formed is enveloped by a sealing housing and arranged so that the compression chamber is closed.

9. The rotary device according to claim 8, wherein the sealing housing comprises an air inlet for introducing air into the open portion of the compression chamber.

10. The rotary device according to claim 8, wherein the sealing housing is arranged to cover the open portion of the following compression chamber so as to increase the volume of air to be compressed in each chamber thereby increasing the maximum compression ratio.

11. The rotary device according claim 8, wherein the sealing housing comprises an exhaust outlet arranged to receive the exhaust gases from the open portion of the sealable compression chamber after combustion has taken place.

12. The rotary device according to claim 1, wherein the protrusions are formed as separate components and configured so as to each be affixable to respective rotors.

13. The rotary device according to claim 1, wherein the protrusions are formed integral with their respective rotors.

14. The rotary device according to claim 1, wherein each of the rotors are cylindrical.

15. The rotary device according to claim 1, wherein the axes of rotation of the rotors are aligned with each other.

16. A rotary engine with a compression and combustion zone, the rotary engine comprising:

(i) first and second rotors disposed adjacent each other and rotatable about substantially parallel axes of rotation, wherein:

(i') each of the first and second rotors has protrusions extending therefrom at regular intervals about the circumference of each to define an open portion of a sealable compression chamber between adjacent protrusions, the open portion bounded by a chamber surface defined by two side surfaces and a rotor surface joining said two side surfaces;

(ii') each of said protrusions has two side surfaces and a projecting end surface, wherein the meeting point between each of said two side surfaces and the projecting end surface defines a tip; and (iii') the first and second rotors are arranged such that upon contra rotation of the rotors, two tips of a first protrusion of the first rotor engages with a chamber surface between a pair of protrusions of the second rotor, and the two tips of the first protrusion are both in constant sealing contact with the chamber surface on the second rotor for a first period of time so as to form a sealed chamber between the end surface of the first protrusion of the first rotor and the chamber surface of the second rotor to execute a chamber stroke, during which first period of time the volume of the chamber is reduced to a minimum volume level by the contra rotation;

wherein, rotational motion of the two rotors upon contra rotation causes at least one of:

(a) prior to sealing of a sealable compression chamber to form the sealed chamber, ambient gas at ambient pressure is received within the sealable compression chamber;

(b) gas within the sealed chamber evacuates directly to ambient atmosphere at the end of the chamber stroke;

wherein an area in which the compression chamber is formed is enveloped by a sealing housing and arranged so that the compression chamber is substantially closed;

(ii) an injector to inject fuel into the sealable compression chamber; and (iii) an ignition device to ignite the fuel in the sealable compression chamber, wherein, during the first period of time, a sealed compression combustion chamber is formed, the volume of the sealed compression chamber is reduced to a predetermined level by the contra rotation, fuel is injected in to the sealed compression combustion chamber and subsequently ignited.

17. The rotary engine according to claim 16, wherein the injector is located within the sealing housing.

18. The rotary engine according to claim 16, wherein one or more injectors is mounted on one or both of the first and second rotors.

19. The rotary engine according to claim 16, wherein the ignition device is located inside the sealing housing.

20. The rotary engine according to claim 16, wherein one or more ignition devices is mounted on one or both of the first and second rotors.

21. The rotary engine according to claim 16, wherein the sealing housing comprises an exhaust outlet arranged to receive the exhaust gases from the compression chamber after combustion has taken place.

22. A compressor comprising:

(i) first and second rotors disposed adjacent each other and rotatable about substantially parallel axes of rotation, wherein:

(i') each of the first and second rotors has protrusions extending therefrom at regular intervals about the circumference of each to define an open portion of a sealable compression chamber between adjacent protrusions, the open portion bounded by a chamber surface defined by two side surfaces and a rotor surface joining said two side surfaces;

(ii') each of said protrusions has two side surfaces and a projecting end surface, wherein the meeting point between each of said two side surfaces and the projecting end surface defines a tip; and (iii') the first and second rotors are arranged such that upon contra rotation of the rotors, two tips of a first protrusion of the first rotor engages with a chamber surface between a pair of protrusions of the second rotor, and the two tips of the first protrusion are both in constant sealing contact with the chamber surface on the second rotor for a first period of time so as to form a sealed chamber between the end surface of the first protrusion of the first rotor and the chamber surface of the second rotor to execute a chamber stroke, during which first period of time the volume of the chamber is reduced to a minimum volume level by the contra rotation;

wherein, rotational motion of the two rotors upon contra rotation causes at least one of:

(a) prior to sealing of a sealable compression chamber to form the sealed chamber, ambient gas at ambient pressure is received within the sealable compression chamber;

(b) gas within the sealed chamber evacuates directly to ambient atmosphere at the end of the chamber stroke;

wherein an area in which the compression chamber is formed is enveloped by a sealing housing and arranged so that the compression chamber is closed; and wherein the sealing housing comprises an air inlet for introducing air into the open portion of the compression chamber;

(ii) at least one one-way valve is located adjacent where the sealed compression chamber is formed to enable gas in the sealed compression chamber to exit the chamber, wherein, during the first period of time a sealed compression chamber is formed, the volume of the sealed compression chamber is reduced to a predetermined level by the contra rotation, and the gas thus compressed is allowed to exit the sealed compression chamber via the at least one one-way valve.

23. The compressor according to claim 22, wherein the exiting gas is collected in a collection device after it exits the at least one one-way valve.

24. The compressor according to claim 22, wherein the sealing housing is arranged to seal substantially half of a compression chamber or open portion during the compression process.

25. The compressor according to claim 22, wherein the at least one one-way valve is located within the sealing housing.

26. The compressor according to claim 22, wherein the at least one one-way valve is located is one or both of the first and second rotors.

27. The compressor according to claim 22, comprising a drive means for driving the compression cycle.

28. The compressor according to claim 22, comprising of a drive train arrangement operatively associating the first and second rotors with one another.

29. A turbine comprising:

(i) first and second rotors disposed adjacent each other and rotatable about substantially parallel axes of rotation, wherein:

(a) each of the first and second rotors has protrusions extending therefrom at regular intervals about the circumference of each to define an open portion of a sealable chamber between adjacent protrusions, the open portion bounded by a chamber surface defined by two side surfaces and a rotor surface joining said two side surfaces;

(b) each of said protrusions has two side surfaces and a projecting end surface, wherein the meeting point between each of said side surfaces and the projecting end surface defines a tip; and (c) the first and second rotors are arranged such that upon contra rotation of the rotors, two tips of a first protrusion of the first rotor engages with a chamber surface between a pair of protrusions on the second rotor, and the two tips of the first protrusion are both in constant sealing contact with said chamber surface of the second rotor for a first period of time so as to form a sealed chamber between the end surface of the first protrusion of the first rotor and the chamber surface of the second rotor to execute a chamber stroke, during which first period of time the volume of the chamber is reduced to a minimum volume level by the contra rotation;

(ii) at least one one-way valve located adjacent where the sealable expandable chamber is formed so as to enable compressed gas to enter the sealable expandable chamber;

wherein the gas enters the sealed expandable chamber via the at least one one-way valve so as to expand the sealed expandable chamber for causing rotation of the two rotors, and wherein rotational motion of the two rotors upon contra rotation causes gas within the sealed expandable chamber to evacuate directly to ambient atmosphere at the end of the chamber stroke.

30. The turbine according to claim 29, wherein each of said protrusions is shaped so as to achieve a predetermined chamber volume.

31. The turbine according to claim 29, wherein one or each of the rotors is provided with a respective internal valve assembly.

32. The turbine according to claim 31, wherein the internal valve assembly comprises a conduit providing fluid communication between the expandable chamber and a compressed gas source.

33. A rotary device comprising first and second rotors disposed adjacent each other and rotatable about substantially parallel axes of rotation, and a sealing housing at least partially enclosing the first and second rotors, wherein:

(i) each of the first and second rotors has protrusions extending therefrom at regular intervals about the circumference of each to define an open portion of a sealable compression chamber between adjacent protrusions, the open portion bounded by a chamber surface defined by two side surfaces and a rotor surface joining said two side surfaces;

(ii) each of said protrusions has two side surfaces and a projecting end surface, wherein the meeting point between each of said two side surfaces and the projecting end surface defines a tip;

(iii) the sealing housing includes an internal sealing surface configured such that upon contra rotation of the rotors, the internal sealing surface temporarily covers one of the said open portions and forms an enclosed volume with the one of the said open portions;

(iv) the first and second rotors are configured such that upon further contra rotation of the rotors, two tips of a first protrusion of the first rotor engages with a chamber surface of the one of the open portions between a pair of protrusions on the second rotor, and the two tips of the first protrusion are both in constant sealing contact with the chamber surface of the second rotor for a first period of time so as to form a sealed chamber between the end surface of the first protrusion of the first rotor and the chamber surface of the second rotor to execute a chamber stroke, during which first period of time the volume of the chamber is reduced to a minimum volume level by the contra rotation;

and wherein the first and second rotors and the internal sealing surface of the sealing housing is configured so that:

(a) prior to sealing of a sealable compression chamber to form the sealed chamber, a mass of ambient gas at ambient pressure is received within the enclosed volume; and (b) upon further rotation of the two rotors, the open portion moves away from the internal sealing surface the mass of ambient gas is immediately compressed by movement of the first protrusion into the open portion to immediately reduce the enclosed volume.

* * * * *